US012207735B2

(12) United States Patent
Zwick et al.

(10) Patent No.: US 12,207,735 B2
(45) Date of Patent: Jan. 28, 2025

(54) COVER ASSEMBLY FOR A CHAIR

(71) Applicant: MillerKnoll, Inc., Zeeland, MI (US)

(72) Inventors: Roland Zwick, Berlin (DE); Johann Burkhard Schmitz, Berlin (DE); Carola Zwick, Berlin (DE)

(73) Assignee: MillerKnoll, Inc., Zeeland, MI (US)

( * ) Notice: Subject to any disclaimer, the term of this patent is extended or adjusted under 35 U.S.C. 154(b) by 134 days.

(21) Appl. No.: 18/177,576

(22) Filed: Mar. 2, 2023

(65) Prior Publication Data

US 2023/0276951 A1 Sep. 7, 2023

Related U.S. Application Data

(60) Provisional application No. 63/316,161, filed on Mar. 3, 2022.

(51) Int. Cl.
*A47C 7/02* (2006.01)
*A47C 31/11* (2006.01)

(52) U.S. Cl.
CPC ..... *A47C 31/11* (2013.01); *A47C 7/021* (2013.01); *A47C 7/0213* (2018.08)

(58) Field of Classification Search
CPC ..... A47C 7/021; A47C 7/0213
See application file for complete search history.

(56) References Cited

U.S. PATENT DOCUMENTS 2,183,828 A 12/1939 Trubitz
3,794,378 A 2/1974 Haslam et al.
4,239,720 A 12/1980 Gerlach et al.
4,396,227 A 8/1983 Neilson
4,588,229 A * 5/1986 Jay ..... A61G 7/05715 297/228.13 X
4,660,888 A 4/1987 Urai
5,013,089 A 5/1991 Abu-Isa et al.
5,102,191 A * 4/1992 Peng ..... A47C 31/02 297/218.5 X
5,230,370 A 7/1993 Gysin
5,255,538 A 10/1993 Day et al.
5,379,615 A 1/1995 Shima
(Continued)

FOREIGN PATENT DOCUMENTS

EP 0867548 A2 9/1998
EP 1193120 A1 4/2002
(Continued)

OTHER PUBLICATIONS

International Search Report and Written Opinion for Application No. PCT/US23/63599 dated Oct. 17, 2023 (9 pages).

*Primary Examiner* — Rodney B White
(74) *Attorney, Agent, or Firm* — Michael Best & Friedrich LLP

(57) ABSTRACT

A cover assembly for a chair includes a chair cover configured to be positioned over at least a portion of a first surface of the chair, and an attachment mechanism configured to couple the chair cover to the chair. The attachment mechanism includes a flexible strip coupled to a perimeter of the chair cover and configured to be arranged on a second surface of the chair, and a tensioning element coupled to the chair cover and including an attachment feature. The attachment feature is configured to be coupled to the chair to create a tensioning force in the chair cover.

22 Claims, 26 Drawing Sheets

(56) References Cited

U.S. PATENT DOCUMENTS

| | | | | |
|---|---|---|---|---|
| 5,393,596 | A | 2/1995 | Tornero et al. | |
| 5,560,677 | A | 10/1996 | Cykana et al. | |
| 5,692,399 | A | 12/1997 | Takahashi et al. | |
| 5,768,758 | A | 6/1998 | Deignan et al. | |
| 5,890,381 | A | 4/1999 | Leeke et al. | |
| 6,048,025 | A | 4/2000 | Tillner | |
| 6,205,822 | B1 | 3/2001 | Roell | |
| 6,276,178 | B1 | 8/2001 | West et al. | |
| 6,302,487 | B1 | 10/2001 | Fujita et al. | |
| 6,345,866 | B1 | 2/2002 | Jackson et al. | |
| 6,397,638 | B1 | 6/2002 | Roell | |
| 6,401,496 | B1 | 6/2002 | Roell | |
| 6,430,969 | B1 | 8/2002 | Roell | |
| 6,644,070 | B2 | 11/2003 | Ikenaga et al. | |
| 6,758,068 | B2 | 7/2004 | Shirasaki et al. | |
| 6,912,877 | B2 | 7/2005 | Yokoyama et al. | |
| 7,240,522 | B2 | 7/2007 | Kondou et al. | |
| D557,528 | S | 12/2007 | True | |
| 7,461,894 | B2 * | 12/2008 | Leeds | B60N 2/7005 297/228.1 X |
| 7,552,604 | B1 | 6/2009 | Waldrop et al. | |
| 7,631,933 | B2 | 12/2009 | Fujita et al. | |
| 7,682,994 | B2 | 3/2010 | Van Emden et al. | |
| 7,731,294 | B2 | 6/2010 | Yasuda et al. | |
| 8,104,832 | B2 | 1/2012 | Fujita et al. | |
| 8,152,235 | B2 | 4/2012 | McElmurry | |
| 8,434,331 | B2 | 5/2013 | Funaki et al. | |
| 9,119,477 | B1 * | 9/2015 | LeRoy | A47C 7/0213 |
| D740,596 | S | 10/2015 | Toh | |
| 9,669,742 | B1 | 6/2017 | Bailey | |
| 9,681,694 | B2 | 6/2017 | Ng et al. | |
| 9,695,529 | B2 | 7/2017 | Ng et al. | |
| 9,856,587 | B2 | 1/2018 | Akit | |
| 10,182,657 | B2 | 1/2019 | Beyer et al. | |
| 10,220,741 | B2 | 3/2019 | Sekino et al. | |
| 10,294,591 | B2 | 5/2019 | Podhajny et al. | |
| 10,315,535 | B2 | 6/2019 | Asai et al. | |
| 10,532,675 | B2 | 1/2020 | Booth et al. | |
| 10,694,864 | B2 * | 6/2020 | Leeds | B60N 2/663 |
| 10,986,925 | B2 * | 4/2021 | Leeds | A47C 7/0213 |
| 11,142,322 | B1 | 10/2021 | Finlay et al. | |
| 11,272,788 | B2 * | 3/2022 | Leeds | B60N 2/7005 |
| 2004/0000173 | A1 | 1/2004 | Keller | |
| 2005/0025936 | A1 | 2/2005 | Snider et al. | |
| 2013/0062918 | A1 | 3/2013 | Itakura | |
| 2016/0206102 | A1 | 7/2016 | Aldrich et al. | |
| 2018/0146736 | A1 | 5/2018 | Koyabu et al. | |
| 2018/0304782 | A1 | 10/2018 | Yoshino et al. | |
| 2019/0106037 | A1 | 4/2019 | Mankame et al. | |
| 2021/0291988 | A1 | 9/2021 | Ashby et al. | |
| 2022/0312974 | A1 * | 10/2022 | Elkaim | A47C 7/622 |

FOREIGN PATENT DOCUMENTS

| | | | |
|---|---|---|---|
| EP | 1680981 | A1 | 7/2006 |
| EP | 2436810 | A2 | 4/2012 |
| EP | 2474653 | A1 | 7/2012 |
| EP | 2757184 | A1 | 7/2014 |
| EP | 3470563 | A1 | 4/2019 |
| JP | 2004244765 | A | 9/2004 |
| JP | 2004339652 | A | 12/2004 |
| JP | 2006204661 | A | 8/2006 |
| JP | 2007016363 | A | 1/2007 |
| JP | 2007224441 | A | 9/2007 |
| JP | 2007277787 | A | 10/2007 |
| JP | 2009108465 | A | 5/2009 |
| JP | 2009255686 | A | 11/2009 |
| JP | 2009262407 | A | 11/2009 |
| JP | 2011202328 | A | 10/2011 |
| JP | 2012132106 | A | 7/2012 |
| JP | 2013050279 | A | 3/2013 |
| JP | 2013087401 | A | 5/2013 |
| JP | 2013256738 | A | 12/2013 |
| JP | 2017070465 | A | 4/2017 |
| JP | 2019157321 | A | 9/2019 |
| WO | 2004088020 | A1 | 10/2004 |
| WO | 2004088021 | A1 | 10/2004 |
| WO | 2005034684 | A1 | 4/2005 |
| WO | 2005040474 | A2 | 5/2005 |
| WO | 2005042818 | A1 | 5/2005 |
| WO | 2005050409 | A2 | 6/2005 |
| WO | 2006011453 | A1 | 2/2006 |
| WO | 2006038465 | A1 | 4/2006 |
| WO | 2008143172 | A1 | 11/2008 |
| WO | 2009084427 | A1 | 7/2009 |
| WO | 2011035285 | A2 | 3/2011 |
| WO | 2014119029 | A1 | 8/2014 |
| WO | 2018097737 | A1 | 5/2018 |
| WO | 2019082876 | A1 | 5/2019 |
| WO | 2020252191 | A1 | 12/2020 |

* cited by examiner

COVER ASSEMBLY FOR A CHAIR

CROSS-REFERENCE TO RELATED APPLICATIONS

This application claims priority to U.S. Provisional Patent Application No. 63/316,161, filed on Mar. 3, 2022, the entire contents of which are incorporated by reference herein.

FIELD OF THE INVENTION

The present invention relates to furniture, such as chairs, and more particularly to covers for chairs.

BACKGROUND

Chairs may be covered by chair covers. These chair covers range in functions such as appearance, comfort, wear resistance, etc. Chair covers may be secured to chairs in various ways.

SUMMARY

The present application provides, in one aspect, a cover assembly for a chair. The chair includes a first surface configured to support a user and a second surface opposite the first surface. The cover assembly includes a chair cover configured to be positioned over at least a portion of the first surface of the chair, and an attachment mechanism configured to couple the chair cover to the chair. The attachment mechanism includes a flexible strip coupled to a perimeter of the chair cover and configured to be arranged on the second surface of the chair, and a tensioning element coupled to the chair cover and including an attachment feature. The attachment feature is configured to be coupled to the chair to create a tensioning force in the chair cover.

The present application provides, in another aspect, a cover assembly for a chair. The cover assembly includes a chair cover, and an attachment mechanism configured to couple the chair cover to the chair. The attachment mechanism including a flexible strip assembly coupled to a perimeter of the chair cover. The flexible strip assembly includes a first part and a second part coupled together via a lap joint, and a tensioning element coupled to the chair cover and including an attachment feature. The attachment feature is configured to be coupled to the chair to create a tensioning force in the chair cover.

The present application provides, in another aspect, a chair assembly including a base and a seat supported by the base. The seat has a seat surface configured to support a user and a bottom surface opposite the first surface. The chair assembly also includes a cover assembly coupled to the seat. The cover assembly includes a chair cover positioned over at least a portion of the seat surface of the seat, and an attachment mechanism coupling the chair cover to the chair assembly. The attachment mechanism includes a flexible strip coupled to a perimeter of the chair cover and arranged on the bottom surface of the seat. The flexible strip defines a cavity. The attachment mechanism also includes a tensioning element coupled to the chair cover and including an attachment feature. The attachment feature is coupled to another component of the chair assembly to create a tensioning force in the chair cover. The attachment feature further includes a spline disposed within the cavity of the flexible strip. A portion of the chair cover is captured between an interior surface of the flexible strip and the spline.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
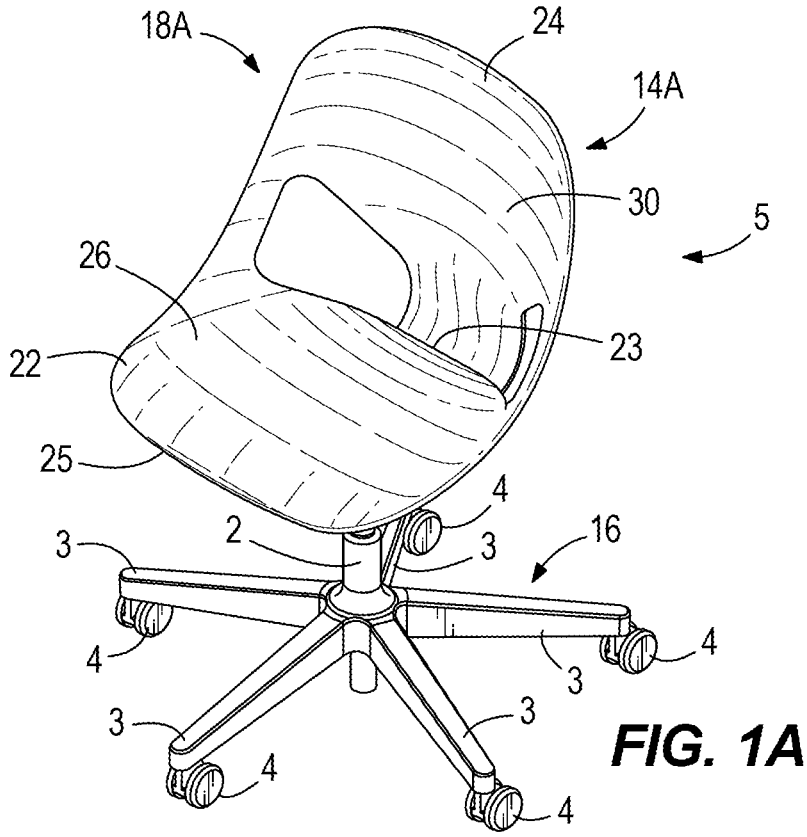
FIG. 1A is a perspective view of a chair according to some embodiments.
Figure 1B:
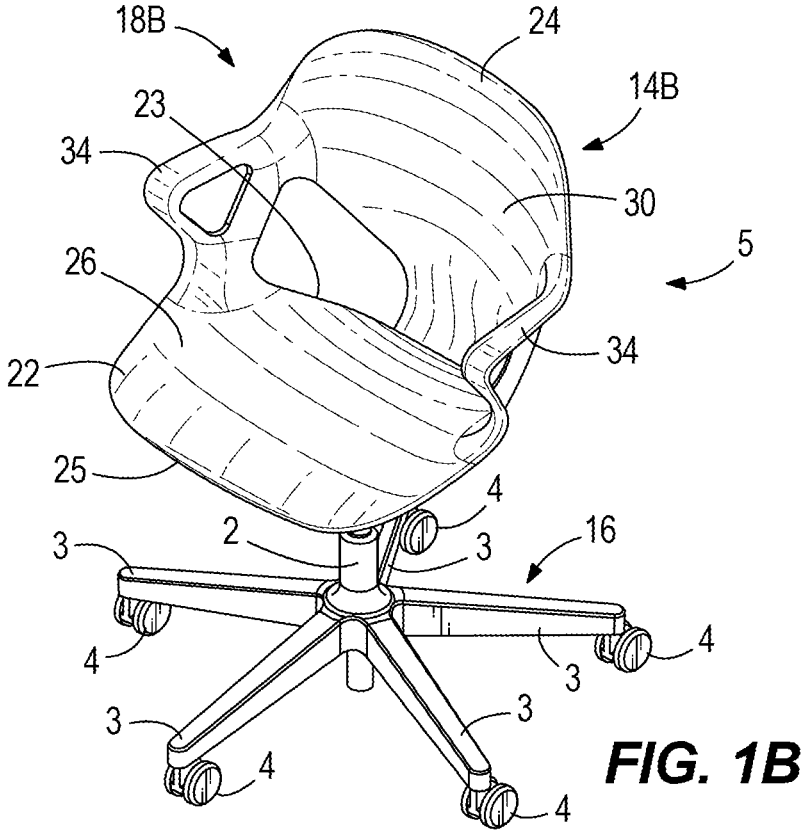
FIG. 1B is a perspective view of another chair according to some embodiments.
Figure 2:
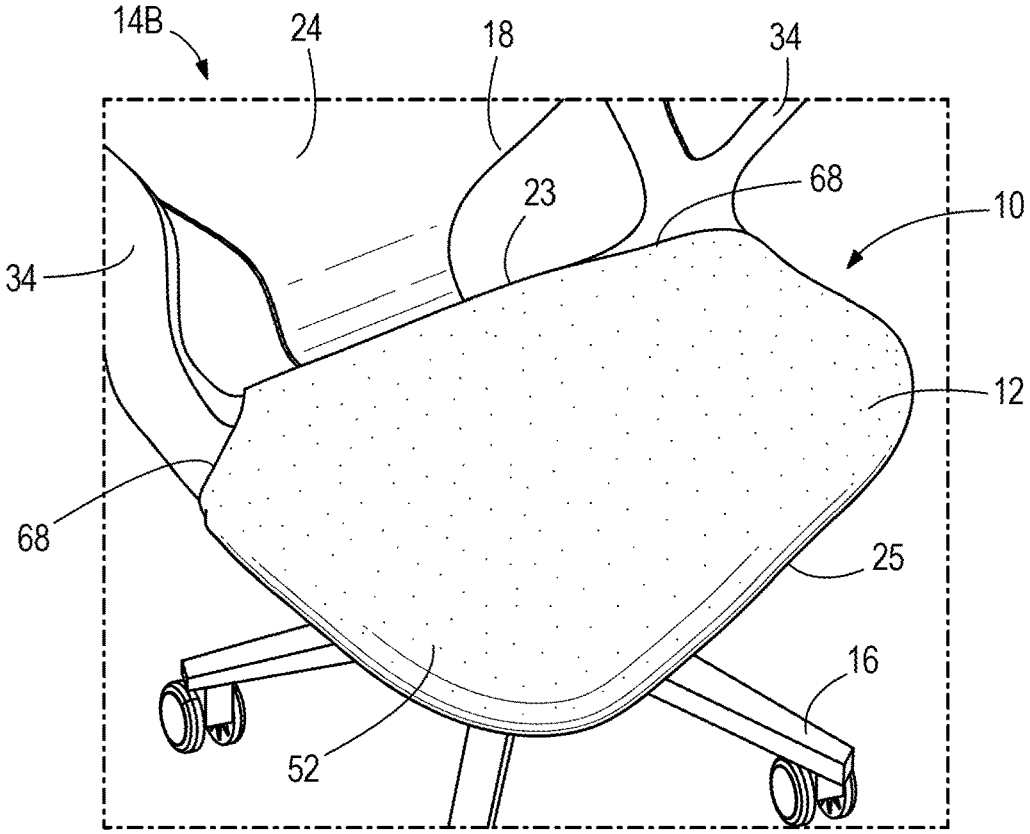
FIG. 2 is a top perspective view of a cover assembly coupled to a chair according to some embodiments.
Figure 3:
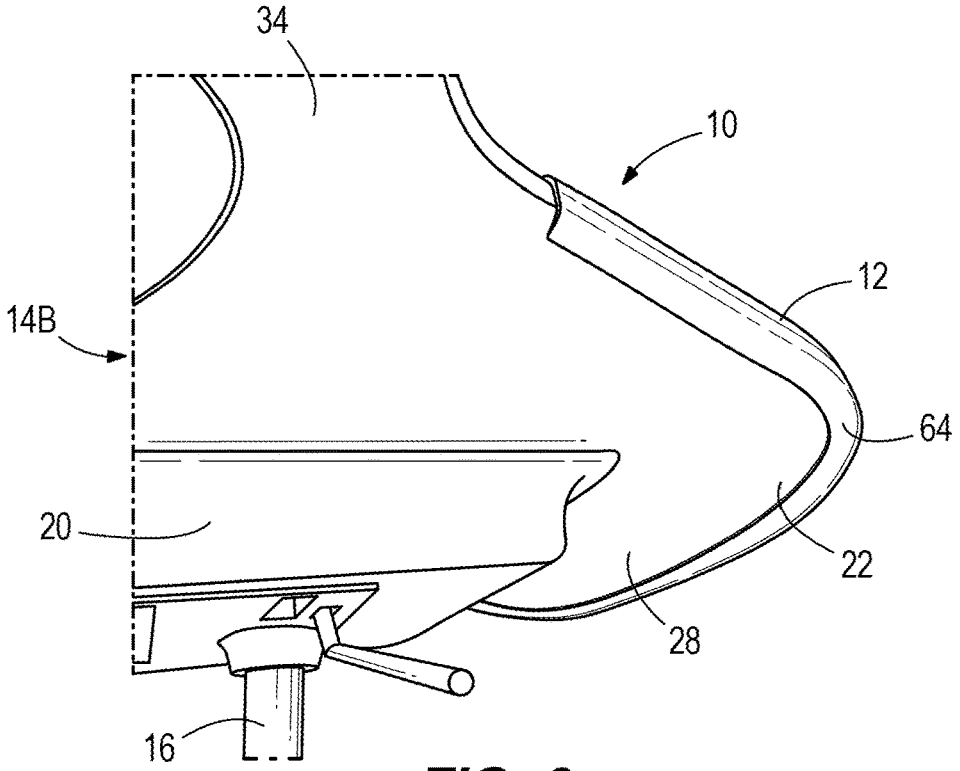
FIG. 3 is a bottom perspective view of the cover assembly and the chair shown in FIG. 2.
Figure 4:
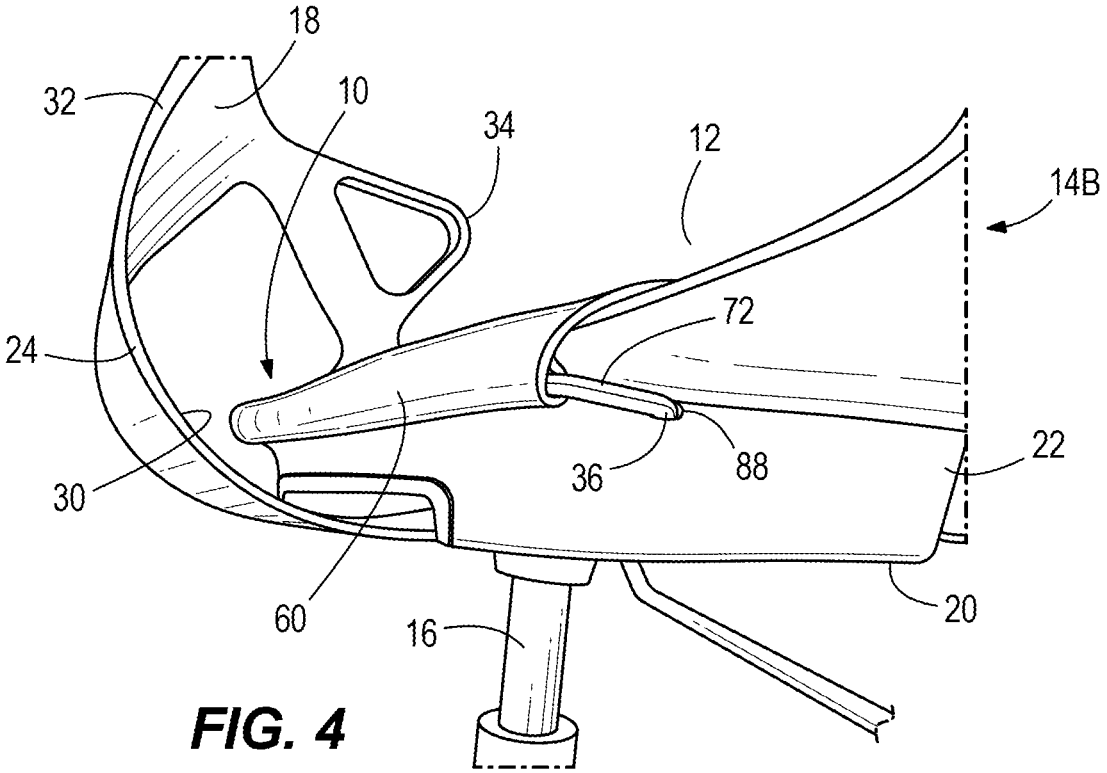
FIG. 4 is a back perspective view of the cover assembly and the chair shown in FIG. 2.

FIGS. 1A and 1B illustrate seating structures 14A, 14B. The illustrated seating structures 14A, 14B are chairs 14A, 14B. Each chair 14A, 14B can be a chair assembly 5 including a base 16, a tilt mechanism 20 (FIG. 3), a seat 22, and a backrest 24. The chair 14B shown in FIG. 1B includes armrests 34, while the chair 14A shown in FIG. 1A does not include armrests 34. In the illustrated embodiments, the bases 16 and the tilt mechanisms 20 are the same, and the seats 22 and the backrests 24 are substantially similar. As illustrated, each of the tilt mechanism 20 is coupled to an upper end of the base 16. The bases 16 each include an upright column 2, a plurality of arms 3 surrounding the column 2, and a plurality of casters 4 coupled to the plurality of arms 3. The tilt mechanism 20 is supported by the column 2. In some embodiments, the base 16 may include a plurality of legs. In some embodiments, the base 16 may include slides instead of casters 4. The tilt mechanism 20 allows a user sitting in the chair 14A, 14B to recline.

Figure 16:
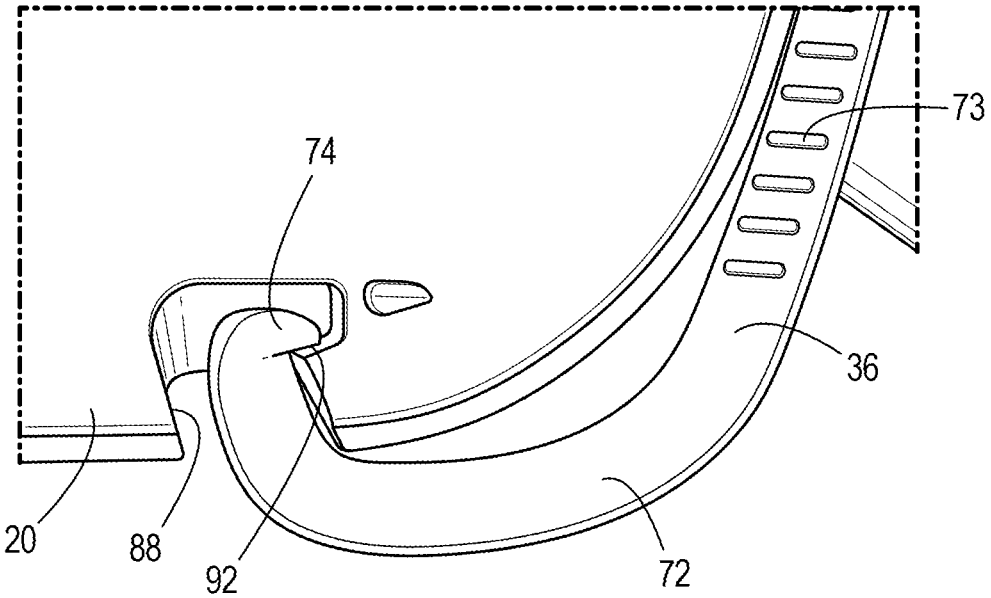
FIG. 16 is an enlarged cross-sectional view of the cover assembly and chair at a seat first end as shown in FIG. 2.
Figure 17:
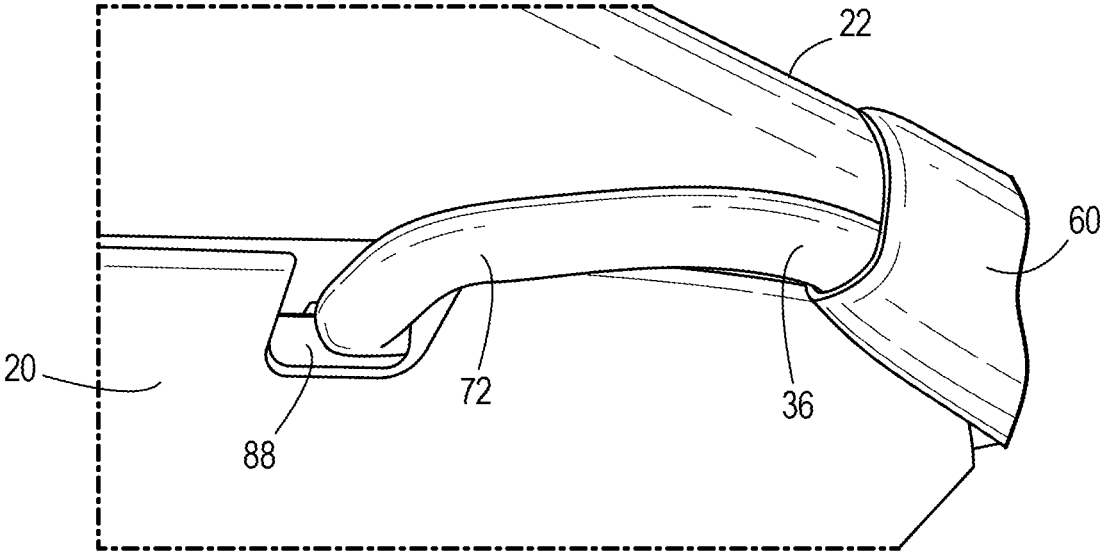
FIG. 17 is an enlarged side view of the cover assembly and chair shown in FIG. 2.

Moving ahead in the drawings, FIGS. 16 and 17 illustrate the tilt mechanism 20 including chair attachment features. In other embodiments, other parts of the chairs 14A, 14B may include chair attachment features. In the illustrated embodiment, the chair attachment features are a pair of recesses 88 on opposite sides of the tilt mechanism 20 and adjacent the backrest 24 (FIGS. 16 and 17). As illustrated, the recesses 88 each have a hook-shaped cross section defining a retention groove 92. In other embodiments, the attachment features can be projections, loops, or hooks.

Referring back to FIGS. 1A and 1B, the seat 22 and the backrest 24 each are movably coupled to the base 16 via the tilt mechanism 20. In other embodiments, the seat 22 and the backrest 24 can be rigidly coupled to the base 16. The seat 22 is supported by the tilt mechanism 20 and by the column 2. The backrest 24 is coupled to the seat 22. In some embodiments, the backrest 24 can be coupled only to the seat 22. In the illustrated embodiment, the seat 22 and backrest 24 are integrally formed as part of a shell 18A, 18B. As shown in FIG. 1B, the armrests 34, the seat 22 and the backrest 24 are integrally formed as the shell 18B. In other embodiments, the seat 22 and backrest 24 may be separate pieces. In the illustrated embodiment, the shell 18A, 18B is movably coupled to the base 16 via the tilt mechanism 20. In some embodiments, the shell 18A, 18B can be rigidly coupled to the base 16.

Figure 5:
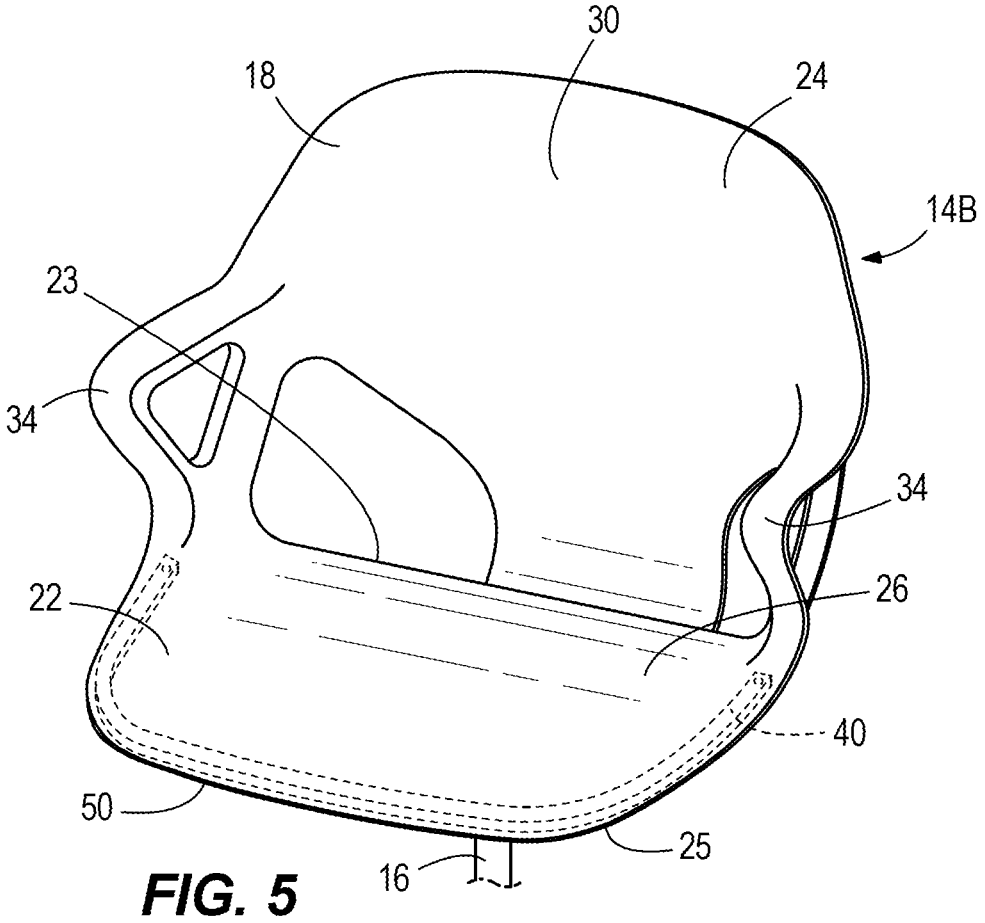
FIG. 5 is a perspective view of the cover assembly and the chair shown in FIG. 2 with a chair cover removed.

With reference to FIGS. 1A, 1B, 14 and 15, the seat 22 forms a seat surface 26 and a bottom surface 28 opposite the seat surface 26. The seat 22 includes a first end 23 adjacent the backrest 24 and a second end 25 opposite the first end 23. The seat 22 defines a perimeter edge 50 (FIG. 5). The backrest 24 forms a front surface 30 and a rear surface 32 opposite the front surface 30. The seat surface 26 and the front surface 30 are configured to be engaged by or support a user sitting in the chair 14A, 14B. The illustrated embodiments of the chairs 14A, 14B are only two examples of a configuration of a chair. The chairs 14A, 14B may have other suitable shapes and/or configurations.

FIGS. 2-4, 6 and 7 illustrate a cover assembly 10. The cover assembly 10 is removably coupled to a seating structure. The cover assembly 10 can be removed from the seating structure and interchanged with other cover assemblies to, for example, change the appearance of the seating structure. The cover assembly 10 can also be cleaned and may provide a padded surface on which to sit. In the illustrated embodiment, the cover assembly 10 is shown in use with the chair 14B with armrests 34 described above. The cover assembly 10 can also be used with the chair 14A described above. Additionally, the cover assembly 10 can be used with seating structures not described herein. The illustrated cover assembly 10 only covers the seat 22 of the chair 14B and does not cover the backrest 24. Still, in other embodiments, the cover assembly 10 can cover only the backrest 24 of the chair 14A or the chair 14B.

Figure 14:
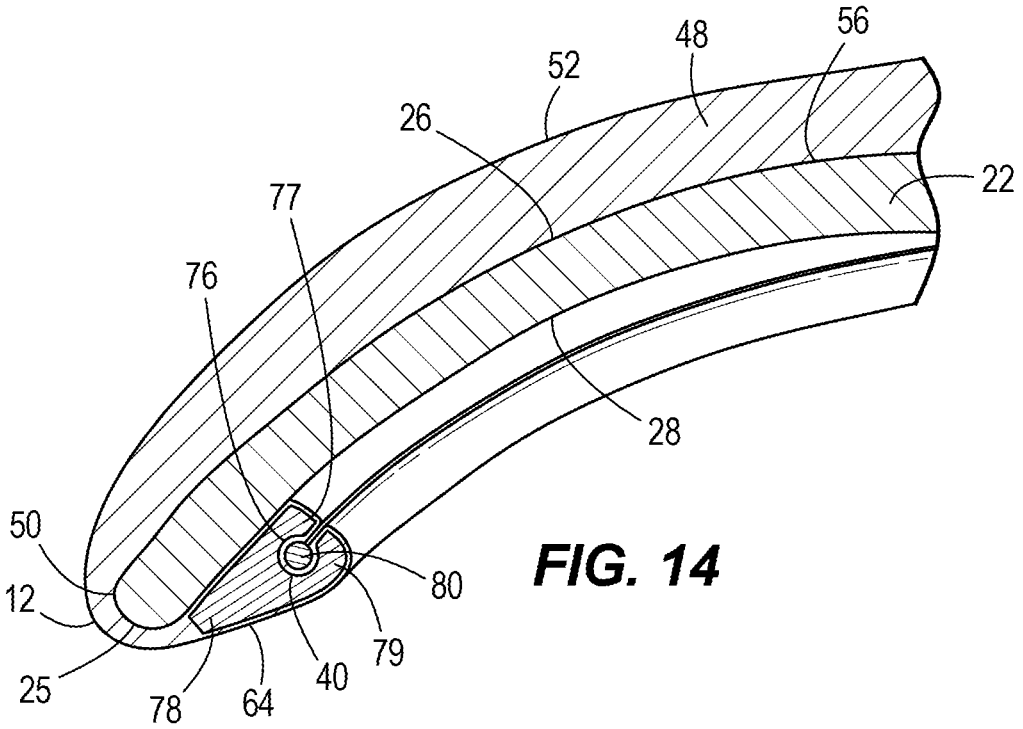
FIG. 14 is an enlarged cross-sectional view of the cover assembly and chair at a seat second end as shown in FIG. 2.

With reference to FIGS. 2-4 and 6-7, the cover assembly 10 includes a chair cover 12 and an attachment mechanism. The attachment mechanism couples the chair cover 12 to the chair 14B. The attachment mechanism includes a tensioning element 36, a keder strip 40 (FIG. 9), and a spline 80 (FIG. 14). The tensioning element 36 and the keder strip 40 create tension or a tensioning force in the chair cover 12 such that the chair cover 12 generally follows the contour of the seat 22. In some embodiments, a cushion 44 may be disposed in the chair cover 12. In other embodiments, the cushion 44 may be disposed between chair cover 12 and the chair 14B. The cushion 44 may be formed from a fill material (e.g., yarn) or foam.

In the illustrated embodiment, the chair cover 12 is formed from a knit material. In other embodiments, the chair cover 12 can be formed from a woven material. In other embodiments, the chair cover 12 can be formed from a non-woven material or fabric. Specifically, the illustrated chair cover 12 is formed by 3D knitting. The chair cover 12 covers the seat surface 26 of the chair 14B. The chair cover 12 includes a main body 48 which covers the seat surface 26. The main body 48 defines an outer surface 52 (FIG. 14) and an inner surface 56 (FIGS. 6 and 7) opposite the outer surface 52. When the chair cover 12 is coupled to the chair 14B, the inner surface 56 faces the seat surface 26. The outer surface 52 is configured to be engaged by the user sitting in the chair 14B.

Figure 6:
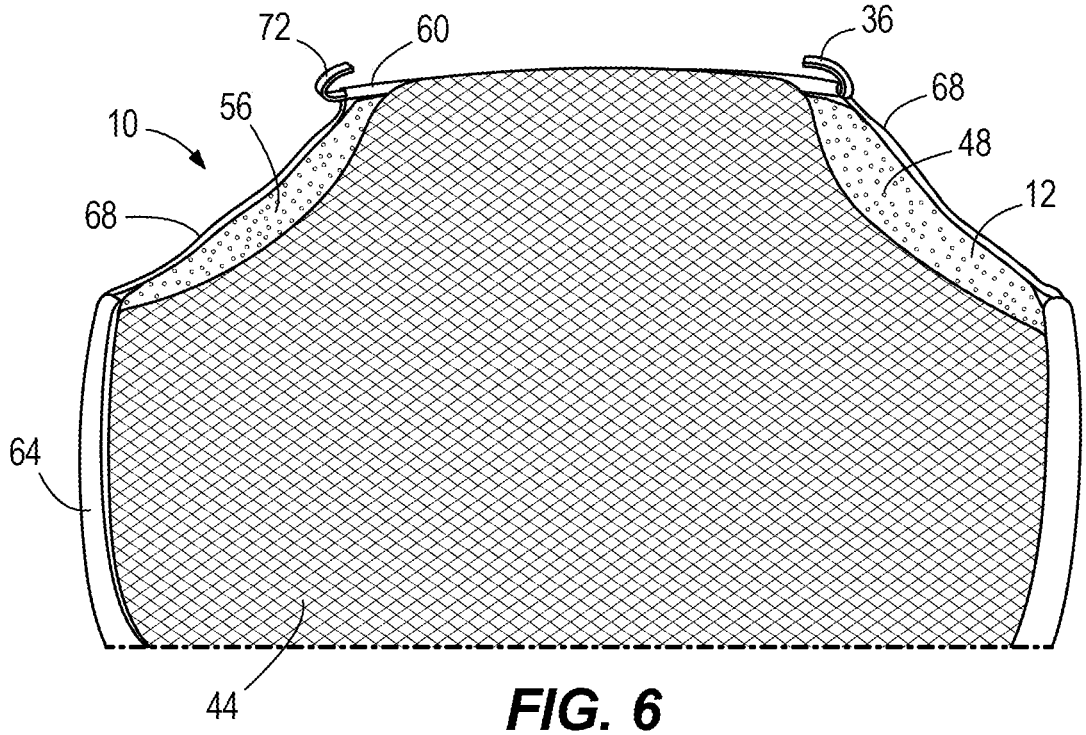
FIG. 6 is a bottom view of the cover assembly shown in FIG. 2 with a cushion.
Figure 7:
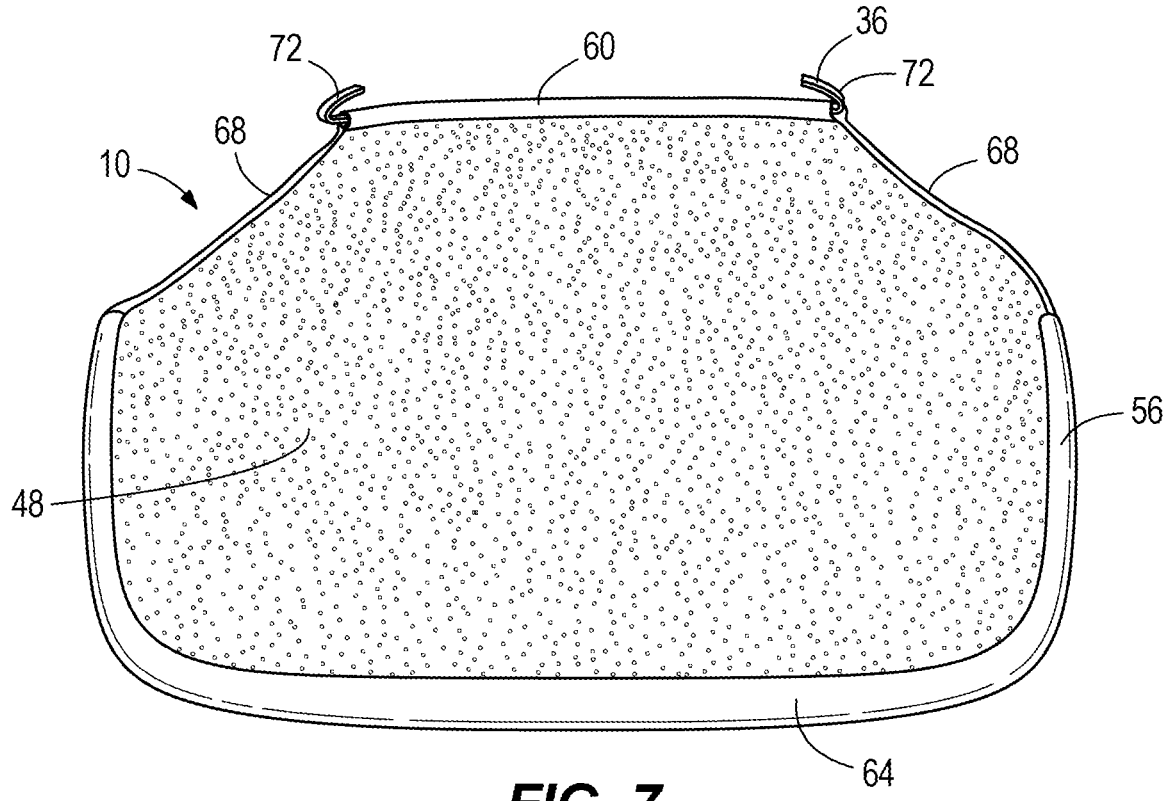
FIG. 7 is a bottom view of the cover assembly shown in FIG. 2.

As shown in FIGS. 6 and 7, the chair cover 12 includes a first receiver 60 and a second receiver 64 each extending from the main body 48. In the illustrated embodiment, the receivers 60, 64 are tubes. Specifically, the receivers 60, 64 are knitted tubes. In other embodiments, the receivers 60, 64 may be a plurality of projections, loops, or recesses in the knit material of the chair cover 12. The first receiver 60 and the second receiver 64 each define a respective channel. In the illustrated embodiment, the receivers 60, 64 are integral with the main body 48. In other embodiments, the receivers 60, 64 may be separate from and coupled to the main body 48. The first receiver 60 and the second receiver 64 each extend partially around an outer perimeter of the chair cover 12. The chair cover 12 includes two cutouts 68 arranged between the first receiver 60 and the second receiver 64. The cutouts 68 define lengths of the outer perimeter of the chair cover 12 which are free from knitted receivers. The cutouts 68 are arranged adjacent the armrests 34 or other structures, when the chair cover 12 is coupled to the chair 14B.

The first receiver 60 is substantially straight. In the illustrated embodiment, the first receiver 60 is formed from the knit material. The second receiver 64 is U-shaped. An open end of the U-shape of the second receiver 64 is open to the first receiver 60. The second receiver 64 overlaps the inner surface 56. In the illustrated embodiment, the second receiver 64 is formed from the knit material.

Figure 8:
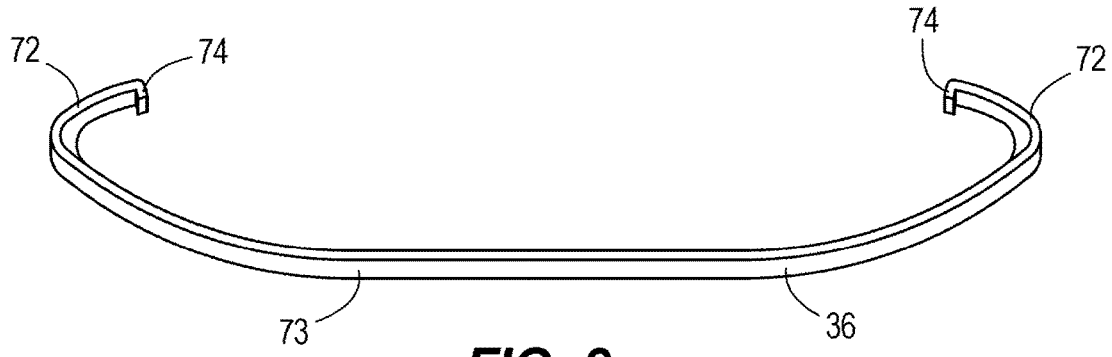
FIG. 8 is a top view of a C-shaped clip of the cover assembly shown in FIG. 2.

As illustrated in FIGS. 6-8, the tensioning element 36 is disposed in the first receiver 60. The illustrated tensioning element 36 is a C-shaped clip. In other embodiments, the tensioning element 36 can include a plurality of clips or other structures. The tensioning element 36 includes a pair of tensioning element attachment features configured to engage the chair attachment features. In the illustrated embodiment, the tensioning element attachment features are hooks 72 at each distal end of the clip 36. In other embodiments, the tensioning element 36 attachment features may be loops, recesses, or projections. In the illustrated embodiment, the tensioning element 36 includes a central segment 73 that extends between the hooks 72 (FIG. 8). The hooks 72 are bent towards each other and towards the central segment 73. Each of the hooks 72 includes a projection 74 extending towards the central segment 73. The projections 74 are elongated in a direction that is substantially perpendicular to an elongated direction of the central segment 73. The tensioning element 36 is partially arranged in the channel of the first receiver 60 such that the hooks 72 extend out of the first receiver 60 (FIG. 6). Additionally, the first receiver 60 covers the central segment 73. In the illustrated embodiment, the tensioning element 36 is made of plastic or polymer material. In other embodiments, the tensioning element 36 may be made of other materials, such as metal.

As illustrated in FIGS. 4 and 15-17, the hooks 72 of the tensioning element 36 extend into the recesses 88 and the projections 74 abut the retention grooves 92. The projections 74 and the retention grooves 92 inhibit the tensioning element 36 from disengaging the chair 14B. The chair cover 12 wraps around the first end 23 of the seat 22 such that the tensioning element 36 in the first receiver 60 is arranged on the bottom surface 28. The tensioning element 36 inhibits the chair cover 12 from disengaging the seat 22 at the first end 23. The tensioning element 36 creates tension in chair cover 12 with the keder strip 40 to secure the chair cover 12 on the seat 22.

FIG. 14 illustrates the spline 80. The spline 80 is an elongated cord. In the illustrated embodiment, the spline 80 has a circular cross-section. In other embodiments, the spline 80 can have a different cross-section shape such as a triangle, oval or arrowhead shape. The spline 80 is sized and shaped to fit in the keder strip 40.

FIGS. 9-11 and 14 illustrate the keder strip 40 according to some embodiments. The keder strip 40 is shaped and sized to fit within the second receiver 64 of the chair cover 12. The keder strip 40 can be an elastic or flexible strip shaped and sized to fit within the second receiver 64 of the chair cover 12. The keder strip 40 is configured to be positioned under the front edge of the second end 25 of the seat 22 to help hold the chair cover 12 on the seat 22. The keder strip 40 is disposed in the second receiver 64 of the chair cover 12. The chair cover 12 wraps around a portion of the perimeter of the seat 22 such that the keder strip 40 in the second receiver 64 is arranged on the bottom surface 28. The chair cover 12 wraps around a portion of the perimeter of the seat 22 such that the keder strip 40 in the second receiver 64 is arranged on the bottom surface 28. The second end 25 of the seat 22 is arranged between the main body 48 and the second receiver 64. The keder strip 40 inhibits the chair cover 12 from disengaging the seat 22 at the perimeter of the seat 22.

Figure 15:
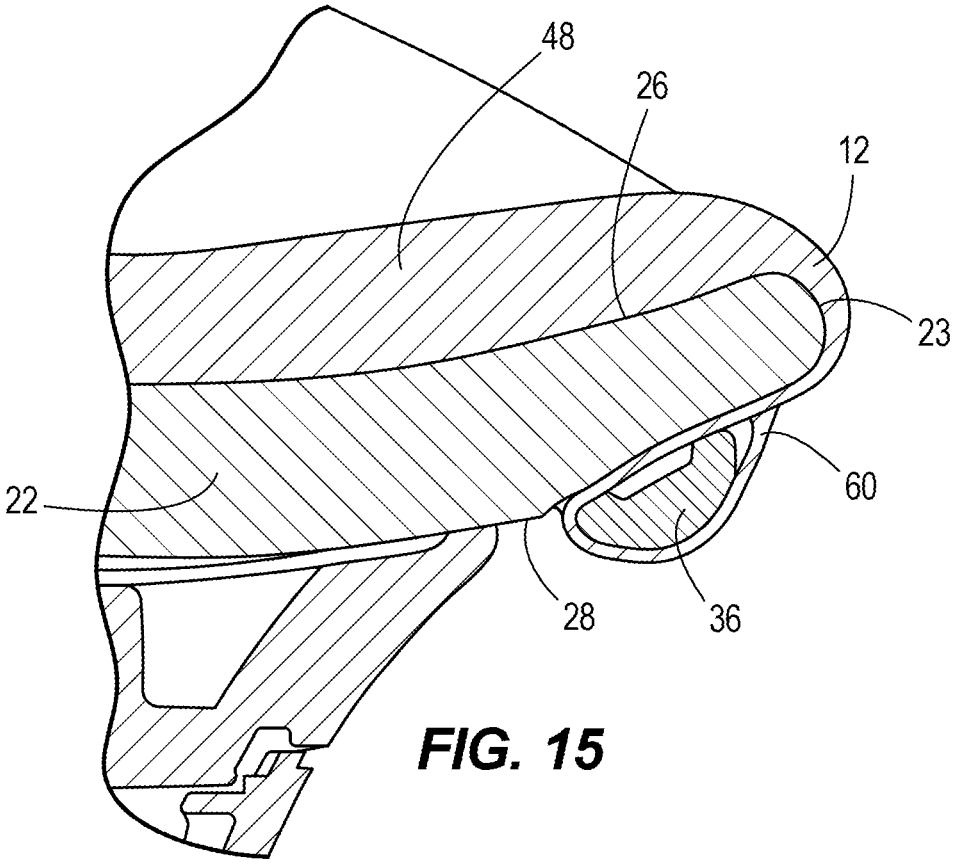
FIG. 15 is an enlarged cross-sectional view of the cover assembly and chair at a seat first end as shown in FIG. 2.

As shown in FIGS. 14 and 15, the keder strip 40 defines a cavity 76 and an opening 77 which opens into the cavity 76. The keder strip 40 may be formed from molded plastic or polymer material. The keder strip 40 can be a strip assembly. The illustrated keder strip 40 includes a first portion 78 and a second portion 79 coupled to the first portion 78. The first portion 78 and the second portion 79 couple together to define the cavity 76. The first portion 78 and the second portion 79 are coupled via a snap-fit or snap-fit connection. In other embodiments, the first portion 78 and the second portion 79 can be coupled via heat staking, or welding (e.g., hot plate welding, vibration welding, etc.). In other embodiments, the first portion 78 and the second portion 79 may be formed as one-piece. The first portion 78 and the second portion 79 define the cavity 76 and the opening 77. The opening 77 has a smaller width or cross-sectional area than the cavity 76. When the cover assembly 10 is coupled to the chair 14B, the first portion 78 is positioned adjacent the seat 22 and the second portion 79 is positioned away from the seat 22.

Figure 9:
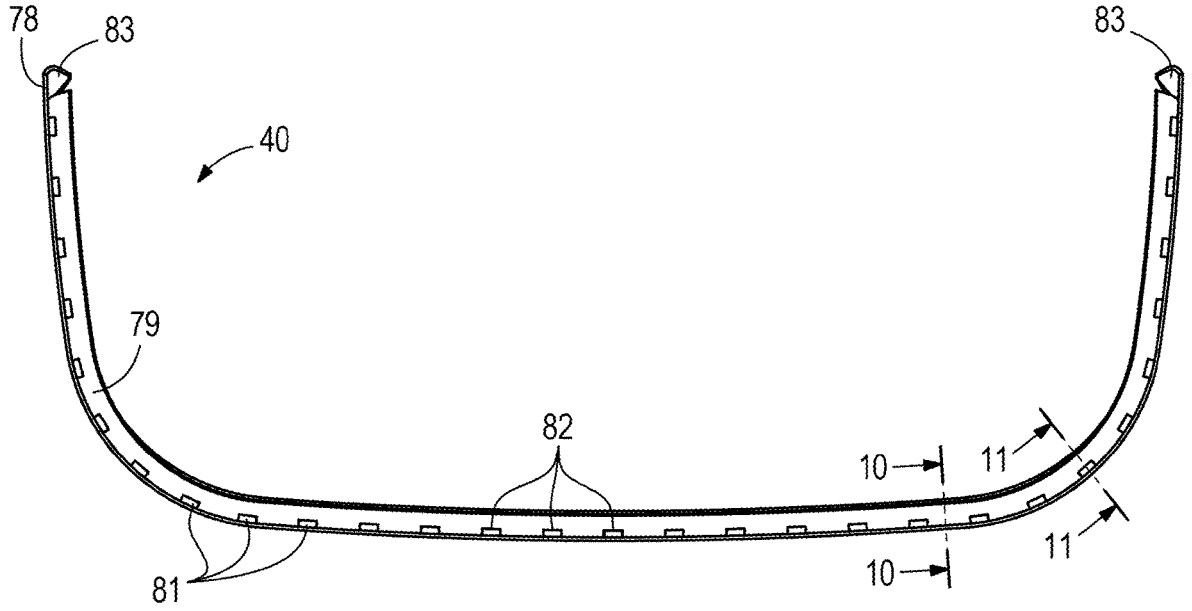
FIG. 9 is a top view of a keder strip of the cover assembly shown in FIG. 2.

As shown in FIG. 9, the first portion 78 of the keder strip 40 includes a plurality of projections 81, where each projection 81 includes a snap hook. The second portion 79 includes a plurality of recesses 82 which receive the projections 81. The snap hooks of the projections 81 retain the projections 81 in the recesses 82 and secure the first portion 78 to the second portion 79. When the first portion 78 and second portion 79 are coupled with each other, the first portion 78 abuts a rear ledge 75 of the second portion 79

Figure 10:
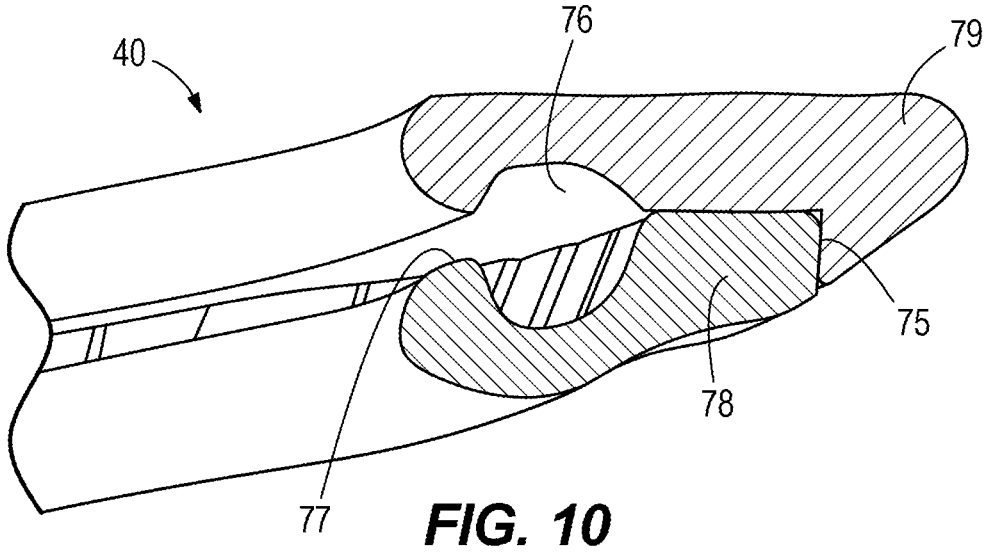
FIG. 10 is a cross-sectional view of the keder strip through section 10-10 in FIG. 9.
Figure 11:
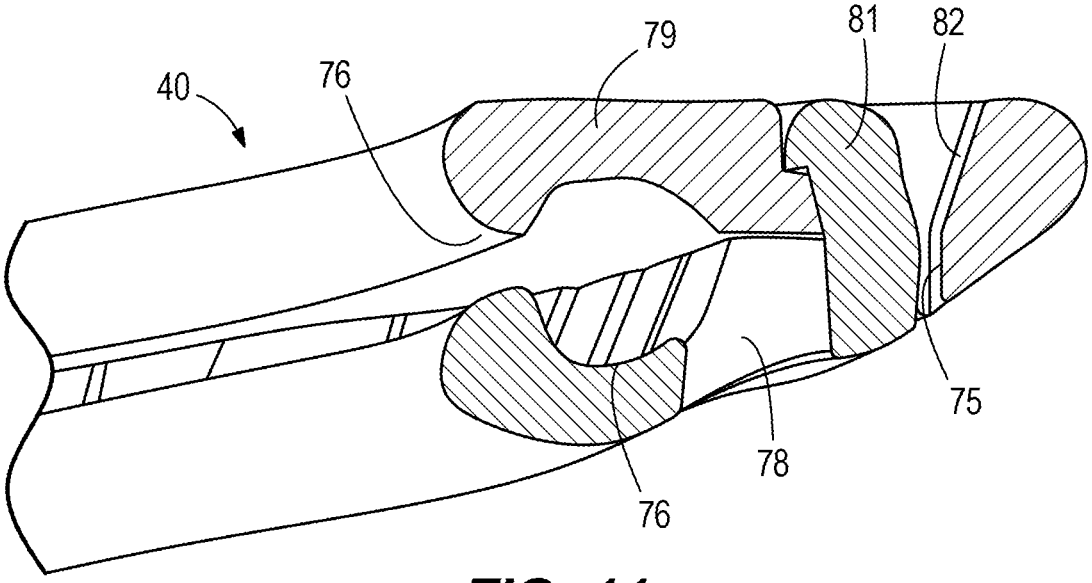
FIG. 11 is a cross-sectional view of the keder strip through section 11-11 in FIG. 9.

(FIGS. 10 and 11). The projections 81 and snap hooks are oriented towards to the opening 77 such that when the spline 80 is pressed through the opening 77 and into the cavity 76, opening forces of the spline 80 are resisted by the rear ledge 75 and the snap hooks.

Figure 12:
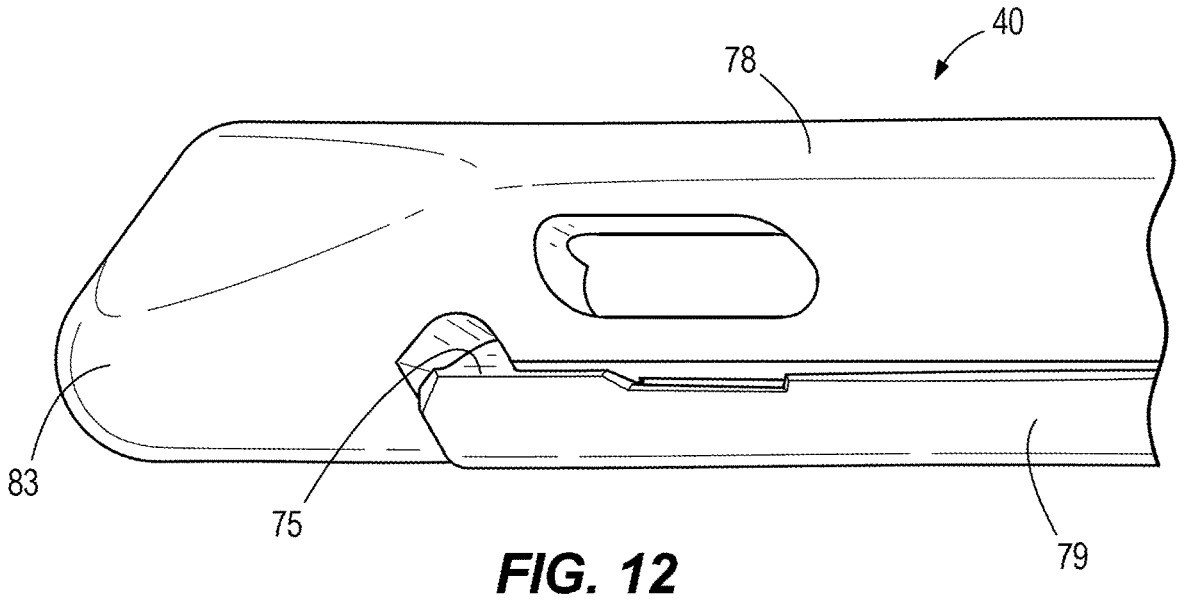
FIG. 12 is an enlarged top view of a portion of the keder strip of the cover assembly shown in FIG. 2.
Figure 13:
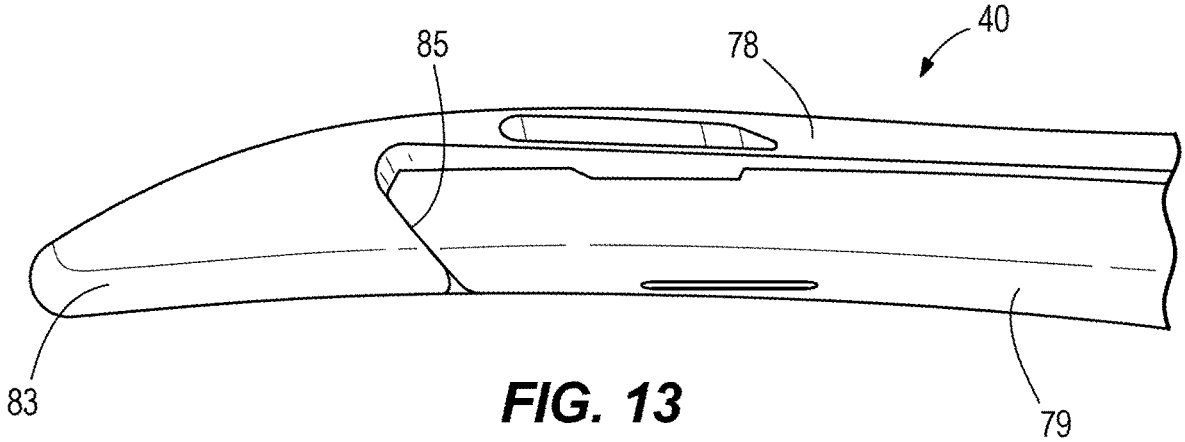
FIG. 13 is an enlarged front view of a portion of the keder strip of the cover assembly shown in FIG. 2.

As shown in FIGS. 12 and 13, the first portion 78 of the keder strip 40 includes a tab 83 at each end, and the second portion 79 includes an undercut 85 at each end. Each undercut 85 engages a respective one of the tabs 83. The undercuts 85 inhibit motion and un-snapping forces between the first portion 78 and the second portion 79. A lifting force on one of the tabs 83 perpendicular to the snap hooks disengages the snap hooks from the second portion 79.

With reference to FIG. 14, the keder strip 40 is arranged in the channel of the second receiver 64. The second receiver 64 wraps around an outer surface of the keder strip 40 and extends into the cavity 76. The spline 80 is disposed in the cavity 76 such that a portion of the second receiver 64 is captured between the keder strip 40 and the spline 80. Specifically, a portion of the second receiver 64 is captured between an interior surface of the keder strip 40 and the spline 80. The second receiver 64 wraps around the spline 80. The width of the spline 80 is larger than the width of the opening 77 such that the spline 80 is inhibited from exiting the cavity 76. The spline 80 also inhibits the second receiver 64 from exiting the cavity 76. The spline 80 and the edge of the chair cover 12 are tucked under and inward relative to the seat 22 such that the spline 80 is not visible from an exterior of the chair cover 12.

To install the cover assembly 10 on the chair 14B, the chair cover 12 is positioned on the seat 22 such that the keder strip 40 in the second receiver 64 is positioned on the bottom surface 28 of the seat 22 and such that the main body 48 of the chair cover 12 covers the seat surface 26. The chair cover 12 is stretched over the first end 23 of the seat 22, and the tensioning element 36 is secured to the recesses 88 of the tilt mechanism 20. The hooks 72 of the tensioning element 36 are secured to the recesses 88 via a snap fit.

To remove the cover assembly 10 from the chair 14B, the hooks 72 of the tensioning element 36 are removed from the recesses 88 of the tilt mechanism 20. The keder strip 40 in the second receiver 64 is then pulled out from the bottom surface 28 of the seat 22.

Figure 18:
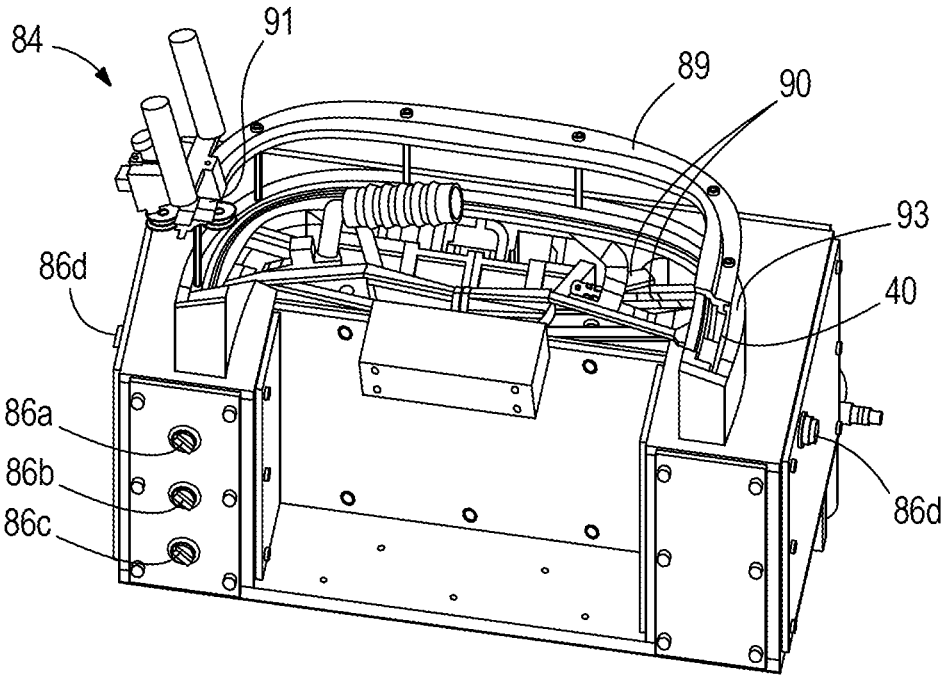
FIG. 18 is a front perspective view of a mounting machine according to some embodiments.
Figure 19:
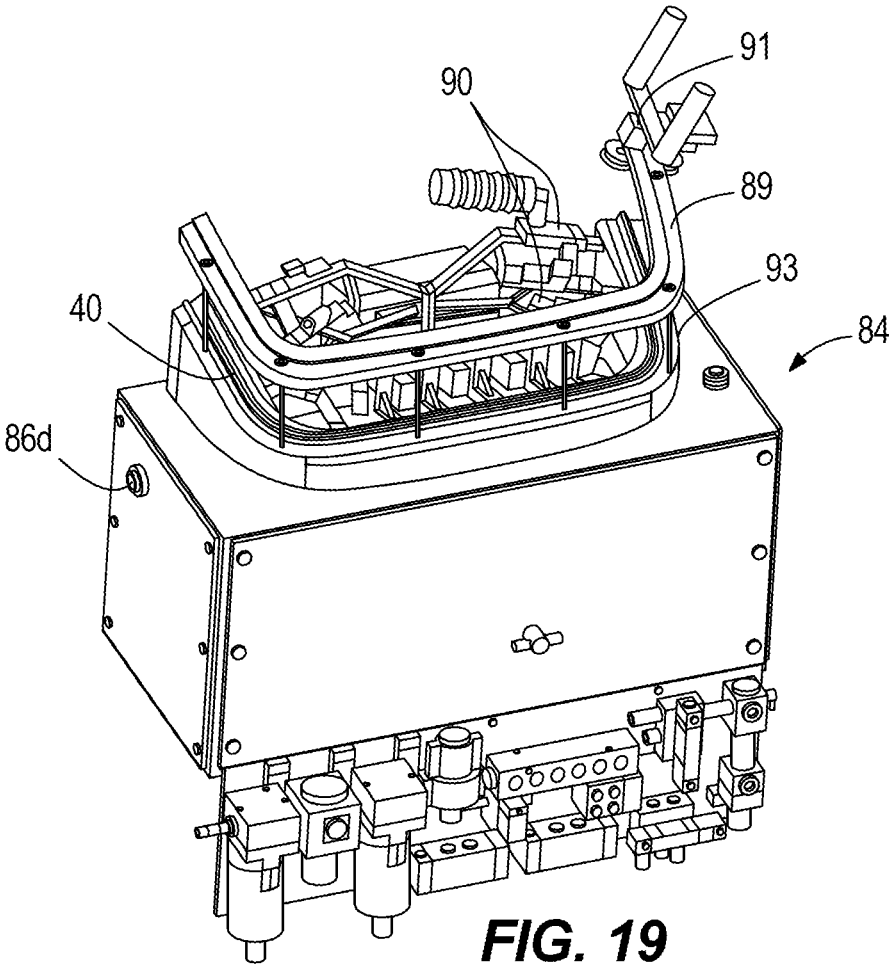
FIG. 19 is a rear perspective view of the mounting machine shown in FIG. 18.

FIGS. 18 and 19 illustrate a mounting machine 84 for a method of inserting the spline 80 into the cavity 76 of the keder strip 40. The mounting machine 84 includes a press having an upper clamp 89 and a lower clamp 93. The upper clamp 89 is movable relative to the lower clamp 93 and can be adjusted to contact or be spaced from the lower clamp 93. The mounting machine 84 also includes a plurality of actuators 86*a*-86*d* configured to turn the mounting aid on or off, to close the press, to open the press, and to apply high pressure on the keder strip 40 via the clamps 89, 93. The mounting machine 84 also includes a roller 91 movably mounted on the upper clamp 89.

To install the keder strip 40 in the chair cover 12, the keder strip 40 is fed through an inlet of the second receiver 64. Once the keder strip 40 is placed in the second receiver 64, a user can open the press such that the upper clamp 89 is spaced from the lower clamp 93 by actuating the actuator 86*b*. The cover assembly 10 is inserted into the press such that the second receiver 64 and the keder strip 40 are positioned on the lower clamp 93. The fabric of the cover assembly 10 is held in place by clips 90. The upper clamp 89 is lowered to contact the keder strip 40 and second receiver 64 manually or by actuating the actuator 86*c*. High pressure is applied to the keder strip 40 and second receiver 64 via the clamps 89, 93 by actuating the actuators 86*d*. The spline 80 is aligned with the opening 77 of the keder 40 and is pressed into the cavity 76 via the roller 91. The press is opened via the actuator 86*c* and the cover assembly 10 is removed from the mounting machine 84.

FIGS. 20-23 illustrate a cover assembly 110 for a chair 114 according to some embodiments. The chair 114 can be similar to the chairs 14A, 14B described above. The chair 114 can include a chair assembly similar to the chairs 14A, 14B described above. The chair 114 includes a base 116, a shell 118, and a tilt mechanism 120. The shell 118 has a seat 122 and a backrest 124. The seat 122 and the backrest 124 define a perimeter edge 150. The perimeter edge 150 is a continuous edge such that the perimeter edge 150 extends along a perimeter of the seat 122 and a perimeter of the backrest 124. Like the chair 14A and unlike the chair 14B, the illustrated chair 114 does not include armrests.

Figure 21:
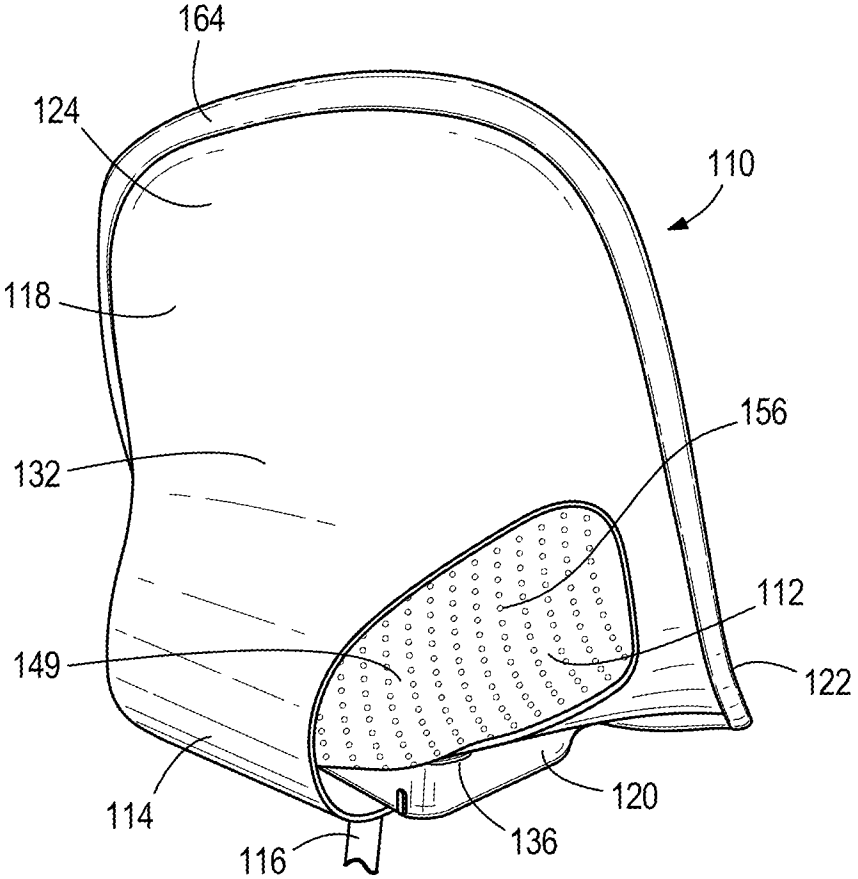
FIG. 21 is a back perspective view of the cover assembly and the chair shown in FIG. 20.
Figure 24:
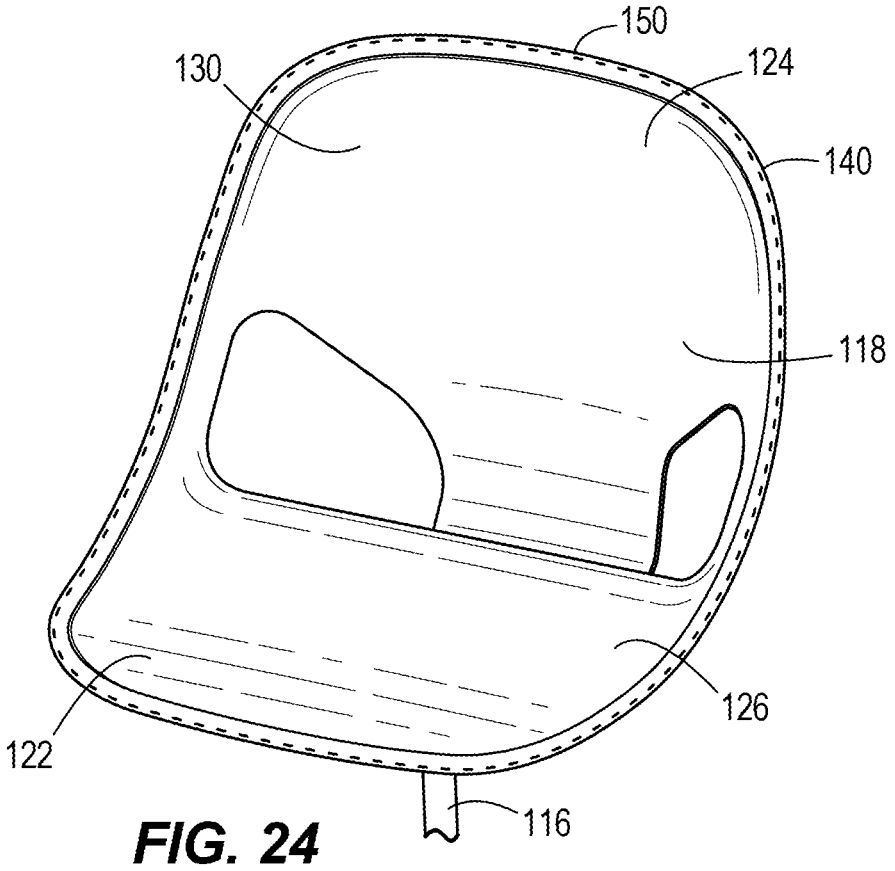
FIG. 24 is a perspective view of the cover assembly and the chair shown in FIG. 20, with a chair cover removed.
Figure 25:
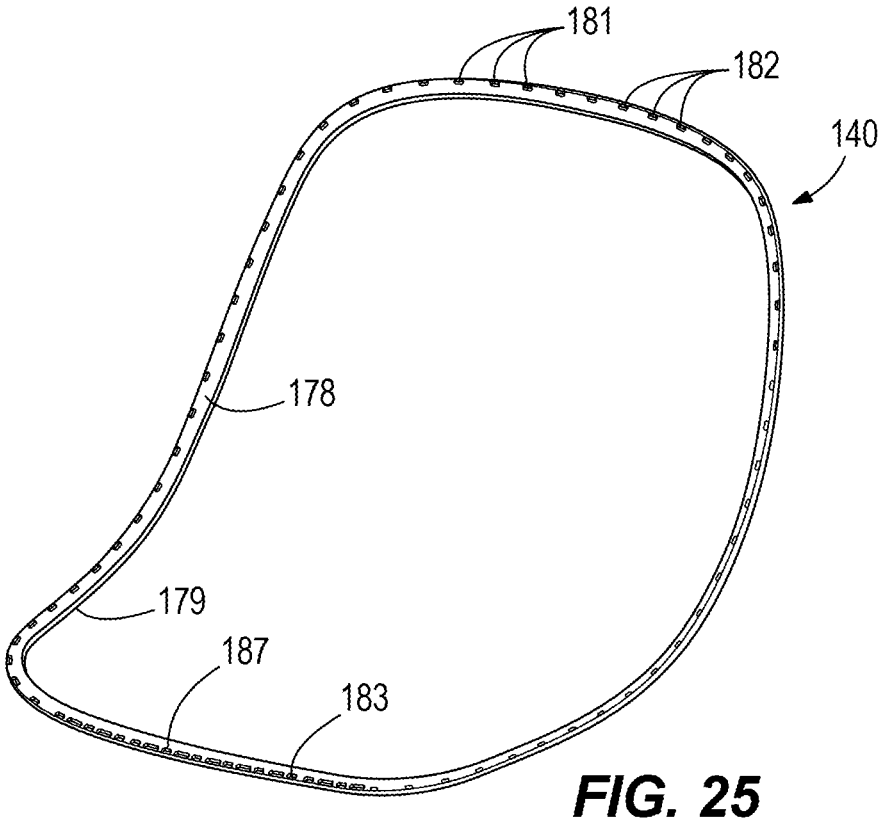
FIG. 25 is a perspective view of a keder strip of the cover assembly shown in FIG. 20.

The cover assembly 110 is similar to the cover assembly 10 described above and includes a chair cover 112 and an attachment mechanism. In the illustrated embodiment, the cover assembly 110 is a continuous cover that covers both the seat 122 and the backrest 124 of the chair 114. The attachment mechanism includes a keder strip 140 and a tensioning mechanism (FIGS. 24 and 25). The tensioning mechanism includes a tensioning element 136 in the form of a C-shaped clip (FIG. 21). The chair cover 112 is formed from a knit material. The chair cover 112 includes a seat cover 148 and a back cover 149. The seat cover 148 and the back cover 149 are knitted as one-piece. The seat cover 148 and the back cover 149 form an inner surface 156 which faces the seat 122 and the backrest 124 of the chair 114 and an outer surface 152 opposite the inner surface 156. The outer surface 152 is configured to be engaged by a user sitting in the chair 114.

Figure 22:
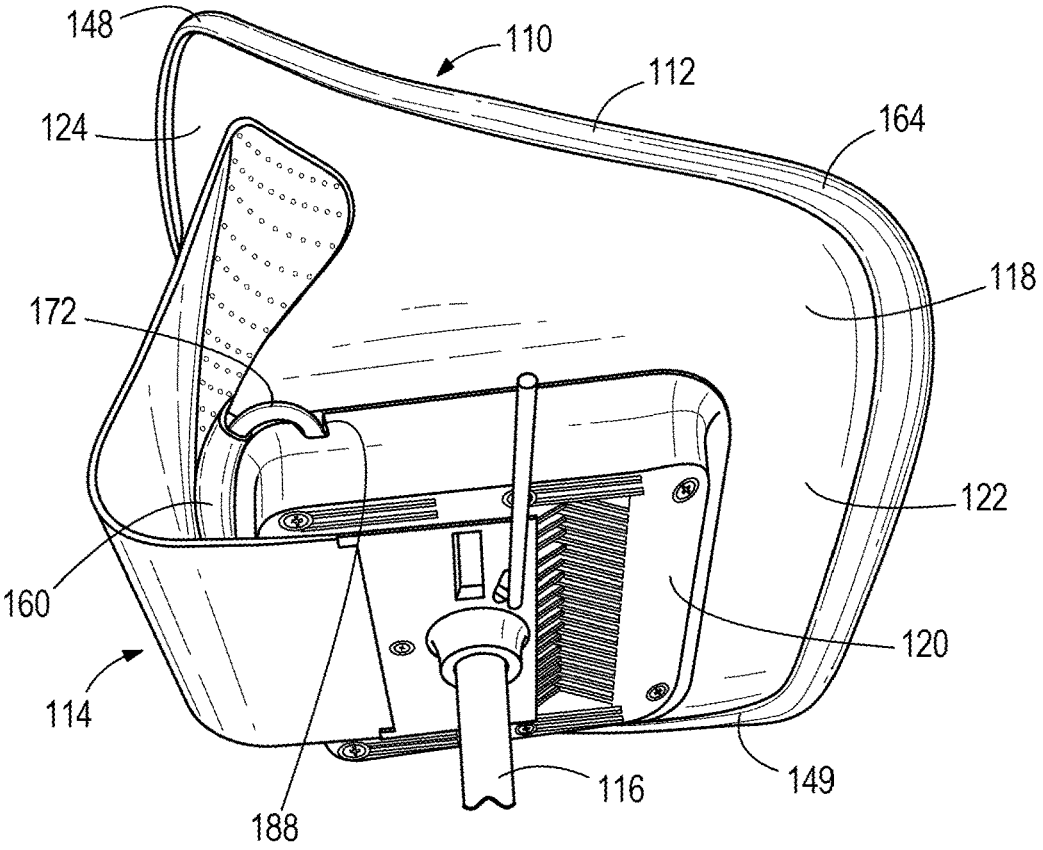
FIG. 22 is a bottom perspective view of the cover assembly and the chair shown in FIG. 20.
Figure 23:
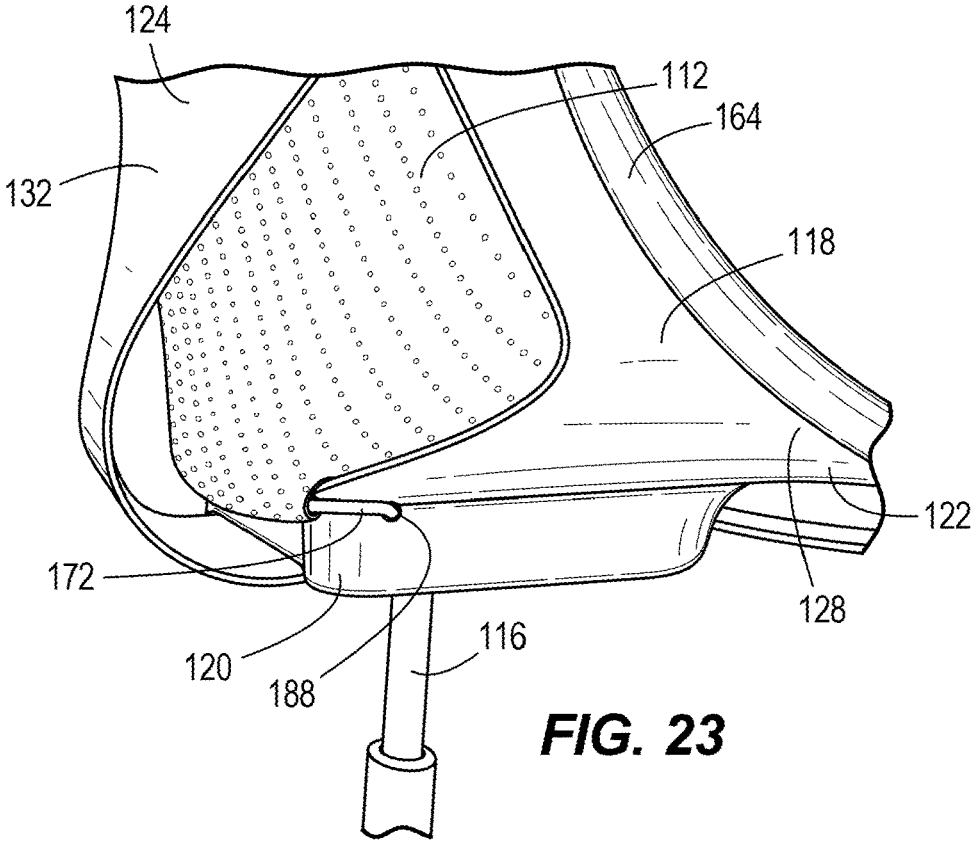
FIG. 23 is a side view of the cover assembly and the chair shown in FIG. 20.
Figure 29:
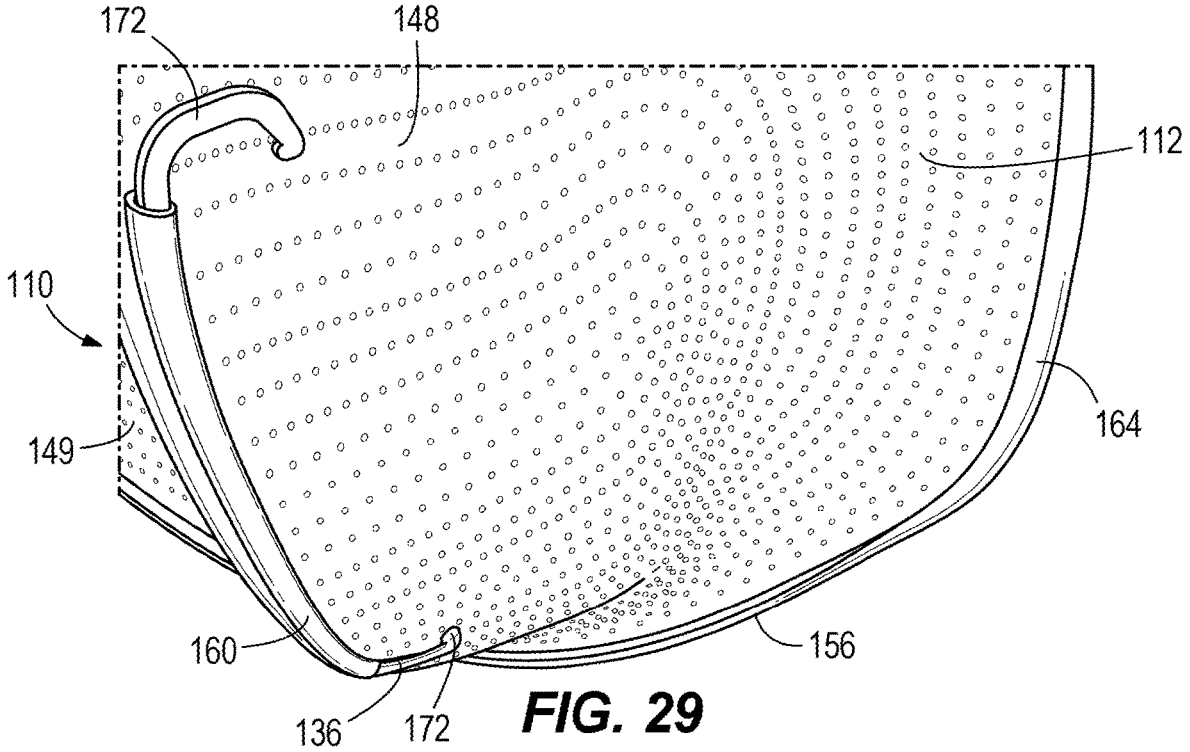
FIG. 29 is an enlarged perspective view of the cover assembly shown in FIG. 20.

With reference to FIGS. 22, 23, and 29, the chair cover 112 includes a first receiver 160 and a second receiver 164 extending from the seat cover 148 and the back cover 149. The first receiver 160 and the second receiver 164 are knitted as one-piece with the seat cover 148 and the back cover 149. The first receiver 160 is arranged at a junction between the seat cover 148 and the back cover 149 and on the inner surface 156. The first receiver 160 is substantially straight. In the illustrated embodiment, the first receiver 160 is formed from the knit material. In some embodiments, the first receiver 160 may be a plurality of projections, loops, or recesses in the knit material of the chair cover 112. The tensioning element 136 is arranged in the first receiver 160 such that a pair of hooks 172 of the clip 136 extend out of the first receiver 160 and toward the seat cover 148.

Figure 20:
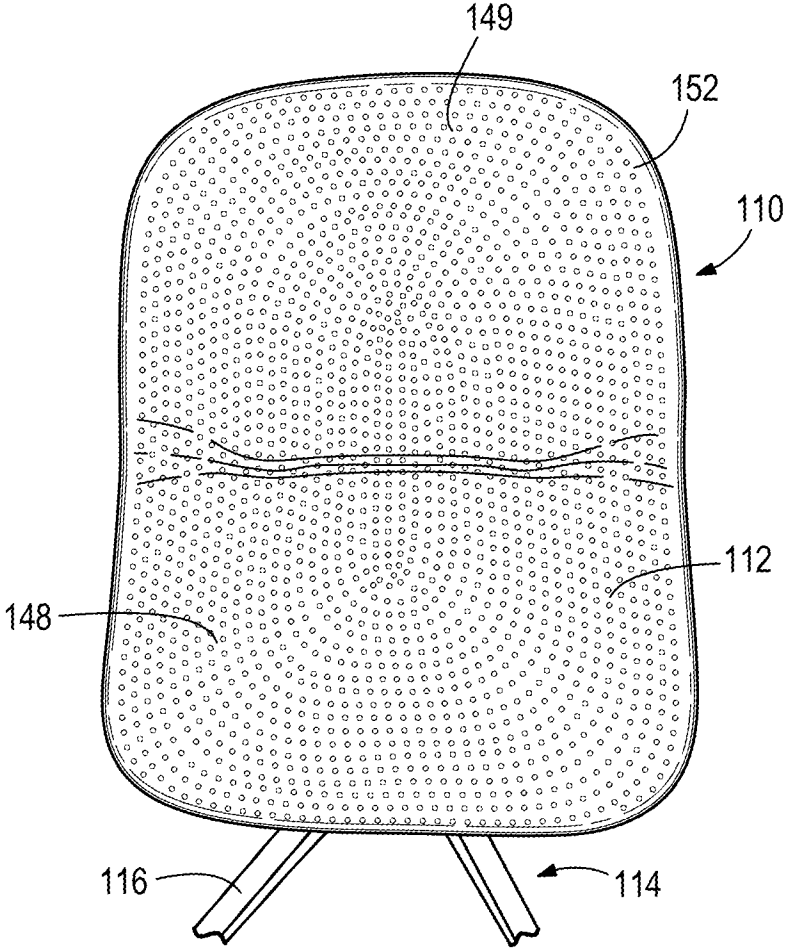
FIG. 20 is a top perspective view of a cover assembly coupled to a chair according to some embodiments.

The second receiver 164 is arranged on a perimeter of the chair cover 112. The second receiver 164 extends around an entire perimeter of the chair cover 112 (FIGS. 20 and 24). The second receiver 164 overlaps the inner surface 156. In the illustrated embodiment, the second receiver 164 is formed from the knit material. In some embodiments, the second receiver 164 may be a plurality of projections, loops, or recesses in the knit material of the chair cover 112. The keder strip 140 extends around the entire perimeter of the chair cover 112. The keder strip 140 is arranged in the second receiver 164. A spline is inserted into the keder strip 140 to secure the keder strip 140, the spline, and the second receiver 164.

Figure 26:
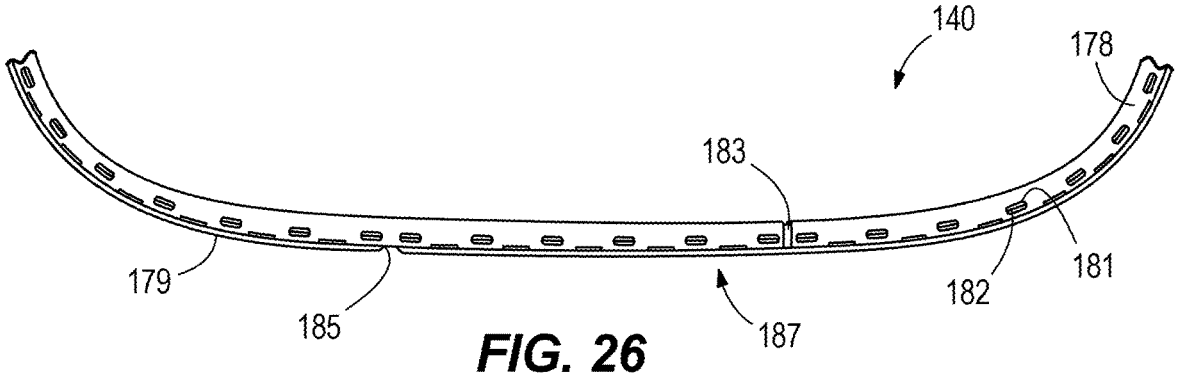
FIG. 26 is an enlarged top view of a portion of the keder strip of the cover assembly shown in FIG. 20.
Figure 27:
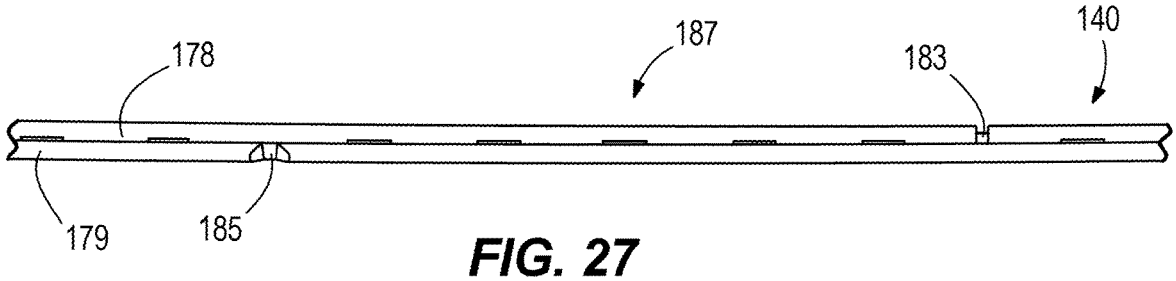
FIG. 27 is an enlarged front view of a portion of the keder strip of the cover assembly shown in FIG. 20.
Figure 28:
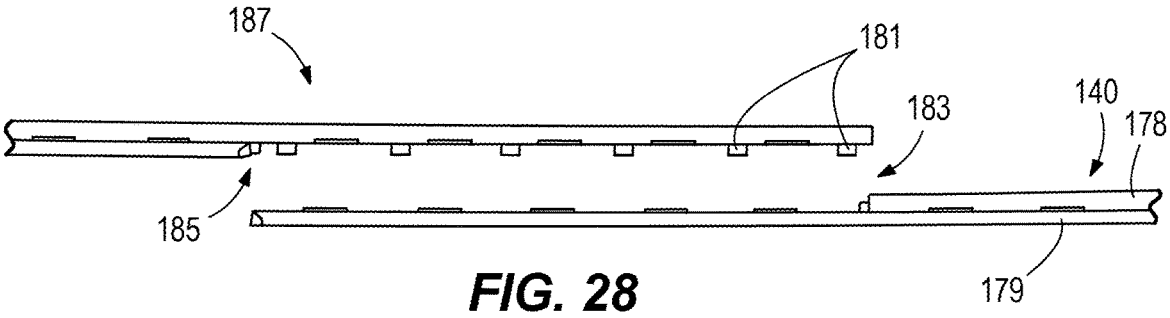
FIG. 28 is a partially exploded view of a portion of the keder strip of the cover assembly shown in FIG. 20.

FIGS. 24-28 illustrate the keder strip 140 according to some embodiments. The keder strip 140 can be an elastic or flexible strip. The keder strip 140 can further be a strip assembly. The keder strip 140 includes a first portion 178 and a second portion 179 coupled to the first portion 178 via a plurality of recesses 182 and a plurality of projections 181 having snap hooks (FIG. 25). The first portion 178 and the second portion 179 each form a loop. Each loop of the first portion 178 and the second portion 179 includes a respective gap 183, 185 (FIG. 26). When the first portion 178 and the second portion 179 are coupled, the gaps 183 and 185 are offset from each other. The keder strip 140 includes a lap joint 187 between the first portion 178 and the second portion 179 (FIGS. 27 and 28). The lap joint 187 creates a closed loop of the keder strip 140. The snap hooks of the projections 181 and the recesses 182 secure the first portion 178 to the second portion 179 in the area of the lap joint 187.

FIGS. 20-24 illustrate the cover assembly 110 coupled to the chair 114. The hooks 172 of the tensioning element 136 are partially arranged in and are retained by recesses 188 of the chair 114. The tensioning element 136 and the keder strip 140 create tension in the chair cover 112 such that the chair cover 112 follows the contour of the seat 122 and the backrest 124. The chair cover 112 stretches over the seat 122 and the backrest 124. The chair cover 112 wraps around the continuous edge 150 of the seat 122 and the backrest 124 (FIG. 20). The second receiver 164 and the keder strip 140 are positioned adjacent the continuous edge 150 of the seat 122 and the backrest 124. The keder strip 140 in the second receiver 164 is arranged on a bottom surface 128 of the seat 122 and a rear surface 132 of the backrest 124. The seat cover 148 and the back cover 149 cover a seat surface 126 of the seat 122 and a front surface 130 of the backrest 124.

To install the cover assembly 110 on the chair 114, the chair cover 112 is positioned on the shell 118 such that the chair cover 112 wraps around the continuous edge 150 of the seat 122 and the backrest 124. The keder strip 140 in the second receiver 164 is arranged on the bottom surface 128 of the seat 122 and the rear surface 132 of the backrest 124. A user increases tension in the cover assembly 110 by pulling the tensioning element 136 at the junction of the seat cover 148 and the back cover 149. The hooks 172 of the tensioning element 136 are secured in recesses 188 of the tilt housing 120 via a snap fit.

To remove the cover assembly 110, the hooks 172 of the tensioning element 136 are removed from the recesses 188 of the tilt housing 120. The keder strip 140 in the second receiver 164 is then removed from around the continuous edge 150 of the shell 118.

Figure 30:
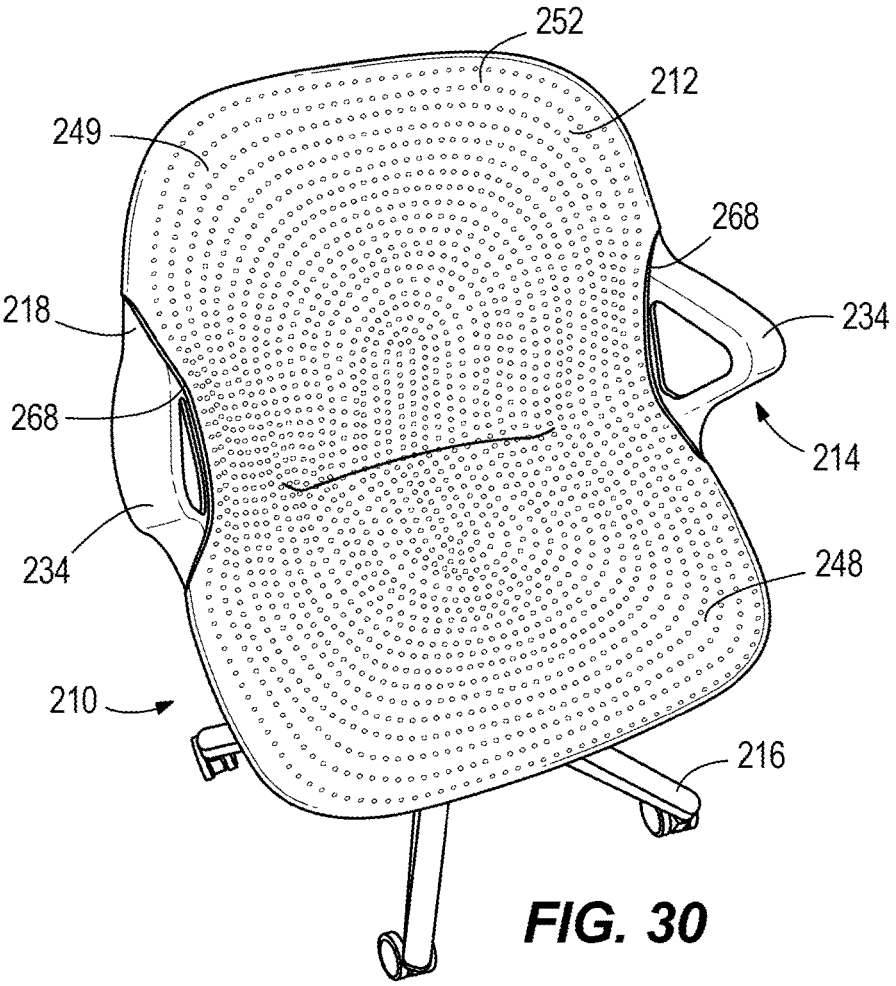
FIG. 30 is a top perspective view of a cover assembly coupled to a chair according to some embodiments.
Figure 34:
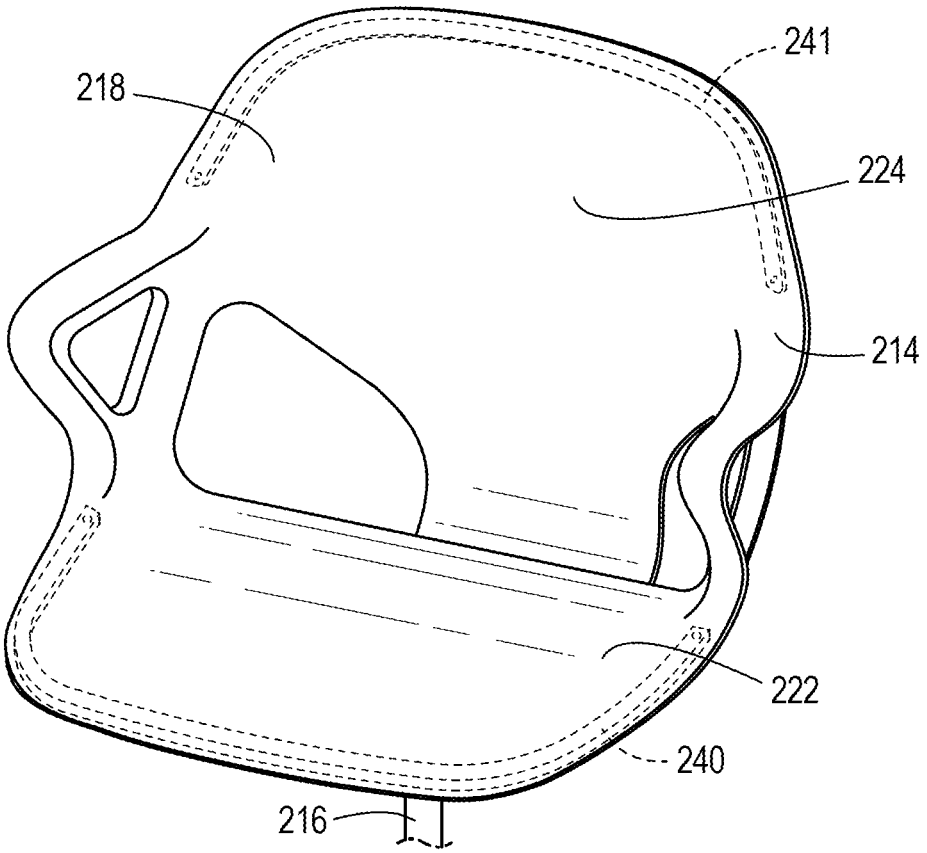
FIG. 34 is a perspective view of the cover assembly and the chair shown in FIG. 30 with a chair cover removed.
Figure 35:
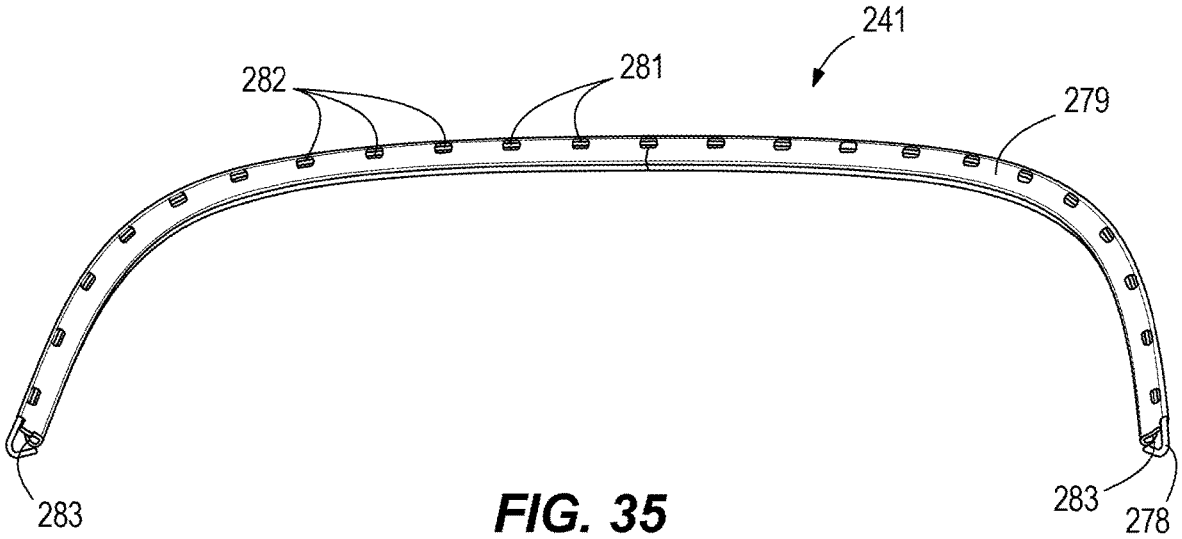
FIG. 35 is a perspective view of a keder strip of the cover assembly shown in FIG. 30.
Figure 36:
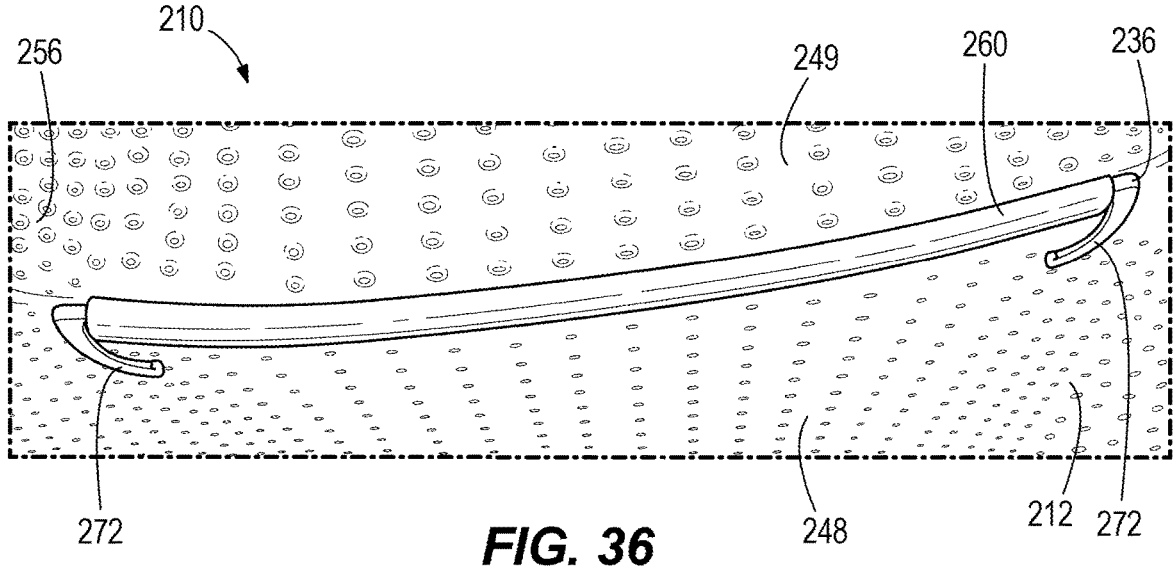
FIG. 36 is an enlarged perspective view of a portion of the cover assembly shown in FIG. 30.

FIGS. 30-33 and 36 illustrate a cover assembly 210 for a chair 214 according to some embodiments. The chair 214 can be similar to the chair 14A described above and includes a base 216, a shell 218, and a receptacle 220. The shell 218 has a seat 222 and a backrest 224. The chair 214 can be similar to the chair 14B described above and includes the shell 218 having armrests 234 between the seat 222 and the backrest 224 (FIG. 30). The cover assembly 210 is similar to the chair cover assemblies 10, 110 described above and includes a chair cover 212 and an attachment mechanism. In the illustrated embodiment, the cover assembly 210 is a continuous cover that covers both the seat 222 and the backrest 224 of the chair 214. The attachment mechanism includes a first keder strip 240, a second keder strip 241 and a tensioning mechanism (FIGS. 34 and 35). The first keder strip 240 can be an elastic or flexible strip. The second keder strip 241 can also be an elastic or flexible strip. The tensioning mechanism includes a tensioning element 236 in the form of a C-shaped clip (FIG. 36). The chair cover 212 is formed from a knit material. The chair cover 212 includes a seat cover 248 and a back cover 249. The seat cover 248 and the back cover 249 are knitted as one-piece. The seat cover 248 and the back cover 249 form an inner surface 256 which faces the seat 222 and the backrest 224 of the chair 214 and an outer surface 252 opposite the inner surface 256. The outer surface 252 is configured to be engaged by a user sitting in the chair 214.

Figure 31:
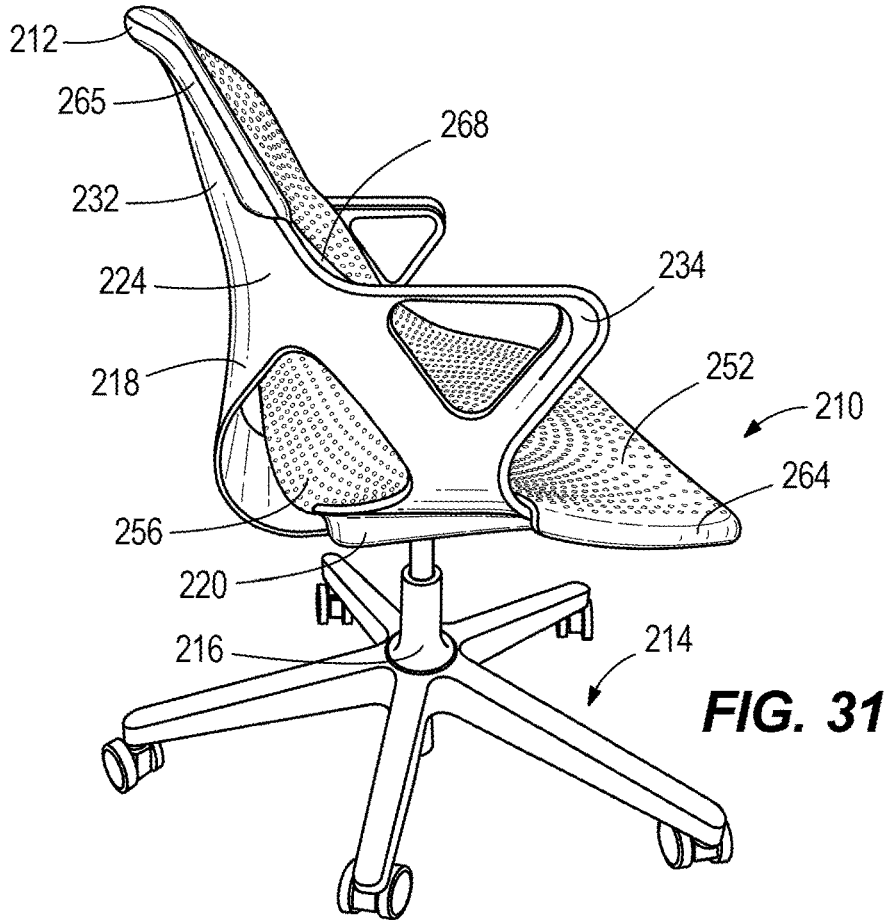
FIG. 31 is a side view of the cover assembly and the chair shown in FIG. 30.
Figure 32:
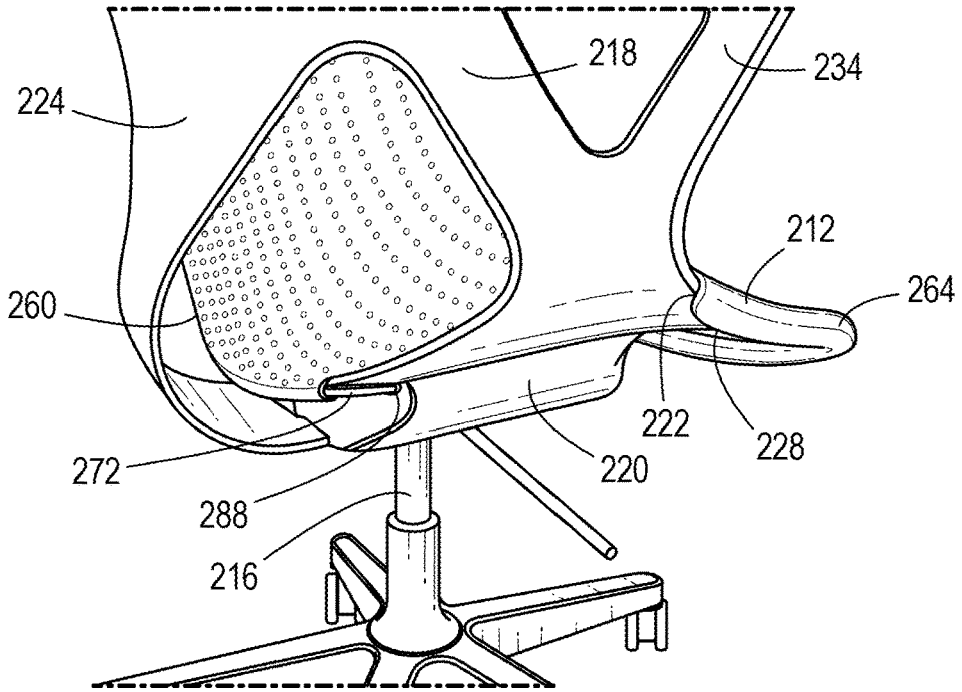
FIG. 32 is a side perspective view of the cover assembly and the chair shown in FIG. 30.

With reference to FIGS. 31 and 32, the chair cover 212 includes a first receiver 260 extending from the seat cover 248 and the back cover 249. The chair cover 212 includes a second receiver 264 extending from the seat cover 248, and a third receiver 265 extending from the back cover 249. The first receiver 260, the second receiver 264 and the third receiver 265 are knitted as one-piece with the seat cover 248 and the back cover 249. Two cutouts 268 are arranged between the second receiver 264 and the third receiver 265. The cutouts 268 define lengths of the perimeter which are free from knitted receivers. The cutouts 268 provide clearance in the chair cover 212 for the armrests 234.

With reference to FIG. 36, the first receiver 260 is arranged at a junction between the seat cover 248 and the back cover 249. The first receiver 260 is substantially straight. In the illustrated embodiment, the first receiver 260 is formed from the knit material. In some embodiments, the first receiver 260 may be a plurality of projections, loops, or recesses in the knit material of the cover 212. The tensioning element 236 is arranged in the first receiver 260 such that a pair of hooks 272 of the tensioning element 236 extend out of the first receiver 260 and toward the seat cover 248.

As shown in FIGS. 30-32, the second receiver 264 is arranged on a perimeter of the cover 212. The second receiver 264 is partially arranged on a perimeter of the seat cover 248 (FIG. 30). The second receiver 264 is U-shaped. An open end of the U-shape of the second receiver 264 faces the first receiver 260. The second receiver 264 overlaps the inner surface 256. In the illustrated embodiment, the second receiver 264 is formed from the knit material. In some embodiments, the second receiver 264 may be a plurality of projections, loops, or recesses in the knit material of the cover 212. The first keder strip 240 is arranged in the second receiver 264. A first spline is inserted into the first keder strip 240 to secure the keder strip 240, the spline, and the second receiver 264.

Figure 33:
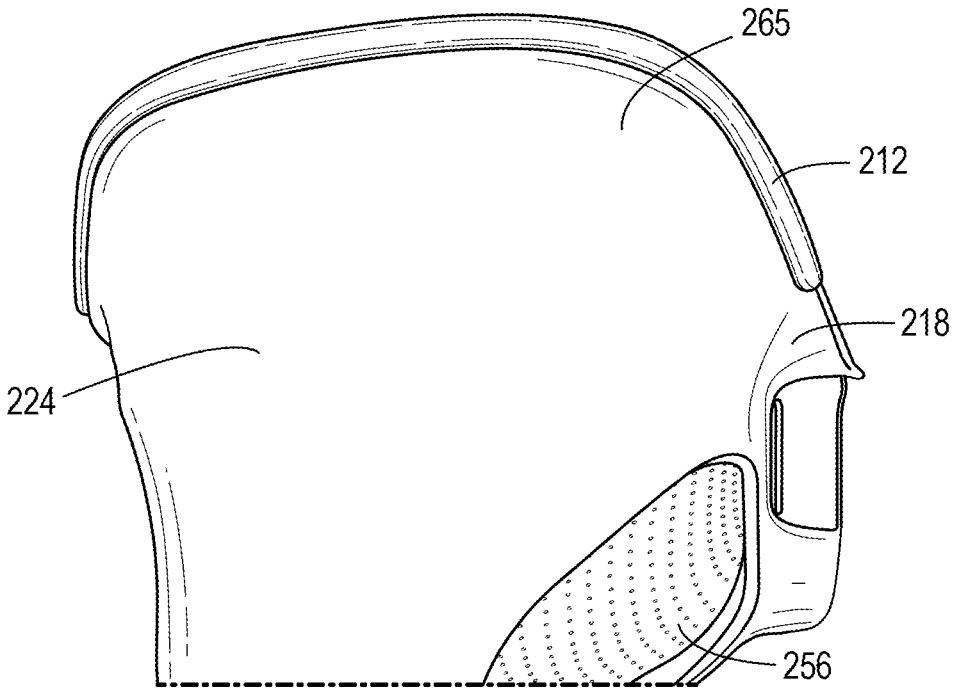
FIG. 33 is a rear perspective view of the cover assembly and the chair shown in FIG. 30.

With reference to FIGS. 31 and 33, the third receiver 265 can be similar to the second receivers 64, 164, or 264 described above. The third receiver 265 is arranged on the perimeter of the cover 212. The third receiver 265 is partially arranged on a perimeter of the back cover 249 (FIG. 30). The third receiver 265 is U-shaped. An open end of the U-shape of the third receiver 265 faces the first receiver 260. The third receiver 265 overlaps the inner surface 256. In the illustrated embodiment, the third receiver 265 is formed from the knit material. In some embodiments, the third receiver 265 may be a plurality of projections, loops, or recesses in the knit material of the cover 212. The second keder strip 241 is arranged in the third receiver 265. A second spline is inserted into the second keder strip 241 to secure the second keder strip 241, the spline, and the third receiver 265.

With reference to FIG. 35, the second keder strip 241 can be similar to the keder strips 40, 140, 240 described above, and the following differences explained below. The keder strip 241 includes a first portion 278 and a second portion 279 coupled to the first portion 278 via a plurality of recesses 282 and a plurality of projections 281 having snap hooks. The first portion 278 includes a tab 283 at each end, and the second portion 279 includes a corresponding undercut at each end, where the undercuts engage the tabs 283. The undercuts inhibit motion and un-snapping forces between the first portion 278 and the second portion 279. A lifting force on one of the tabs 283 perpendicular to the snaps dis-engages the snap hooks from the second portion 279.

FIGS. 30-34 illustrate the cover assembly 210 coupled to the chair 214. The hooks 272 of the tensioning element 236 are partially arranged in and are retained by recesses 288 of the chair 214. The tensioning element 236 and the keder strips 240, 241 create tension in the cover 212 such that the cover 212 follows the contour of the seat 222 and the backrest 224. The cover 212 stretches over the seat 222 and the backrest 224. The cover 212 wraps around an upper edge of the backrest 224 and a front edge of the seat 222. The second receiver 264 is positioned adjacent the front edge of the seat 222, and the third receiver 265 is positioned adjacent the upper edge of the backrest 224. The first keder strip 240 in the second receiver 264 is arranged on a bottom surface 228 of the seat 222. The second keder strip 241 in the third receiver 265 is arranged on a rear surface 232 of the backrest 224. The seat cover 248 and the back cover 249 cover a seat surface of the seat 222 and a front surface of the backrest 224. The cutouts 268 are arranged adjacent the armrests 234.

To install the cover assembly 210 on the chair 214, the chair cover 212 is positioned on the shell 218 such that the chair cover 212 wraps around the upper edge of the backrest 224 and the front edge of the seat 222. The first keder strip 240 in the second receiver 264 is arranged on the bottom surface 228 of the seat 222, and the second keder strip 241 in the third receiver 265 is arranged on the rear surface 232 of the backrest 224. A user increases tension near the tensioning 236 in the cover assembly 210 by pulling at the junction of the seat cover 248 and the back cover 249. The hooks 272 of the tensioning 236 are secured in the recesses 288 of the receptacle 220.

To remove the cover assembly 210 from the chair 214, the hooks 272 of the tensioning element 236 are removed from the recesses 288 of the receptacle 220. The first keder strip 240 in the second receiver 264 is removed from the bottom surface 228 of the seat 222. The second keder strip 241 in the third receiver is removed from the rear surface 232 of the backrest 224.

Figure 37:
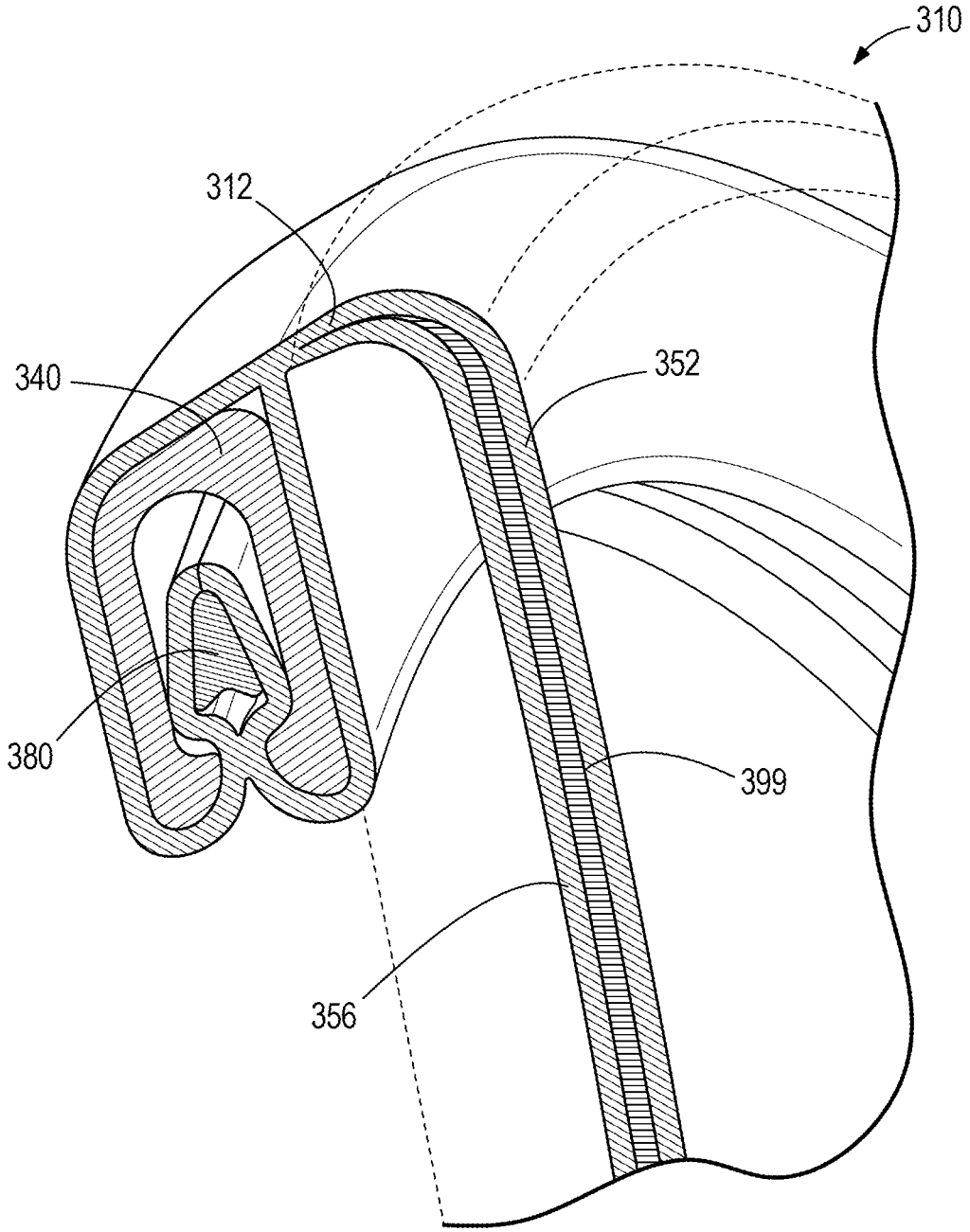
FIG. 37 is a cross-sectional view of a cover assembly according to some embodiments.

FIG. 37 illustrates a cover assembly 310 for a chair according to some embodiments. The cover assembly 310 is similar to the chair cover assemblies 10, 110, 210 described above, and the following differences explained below. The cover assembly 310 further includes a cover 312 with a padding 399 between a knitted outer surface 352 and a knitted inner surface 356. In some embodiments, the padding 399 is a foam or yarn fill. The cover assembly 310 also includes a keder strip 340 and a spline 380 having an arrowhead cross-section. The keder strip 340 can be an elastic or flexible strip 340. An outer seam of the chair cover 312 is at a tip of the arrowhead cross-section of the spline 380.

Figure 38A:
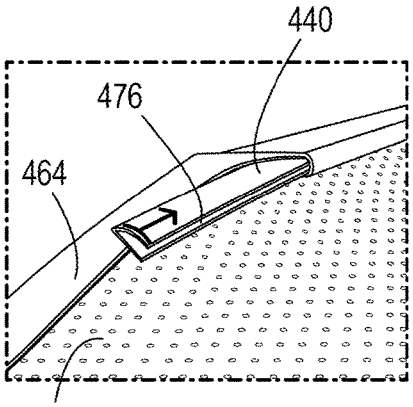
FIG. 38A-38I illustrate a method of installing a keder strip in a chair cover according to some embodiments.
Figure 38B:
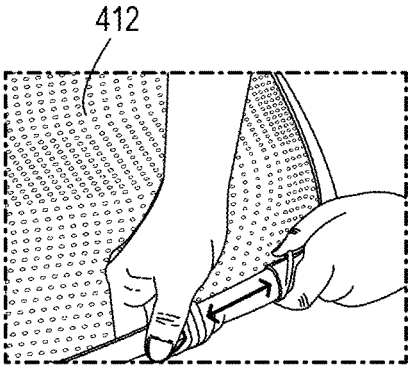
Figure 38C:
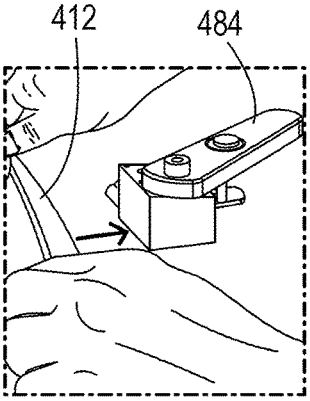
Figure 38D:
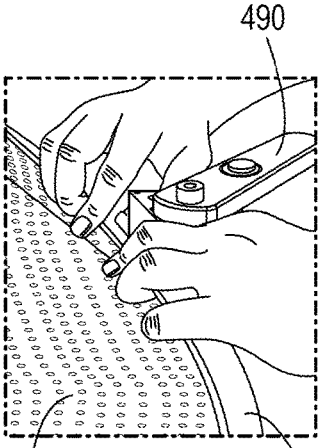
Figure 38E:
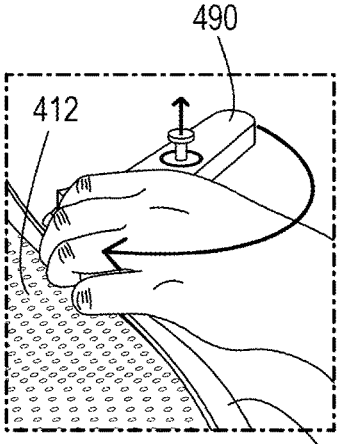
Figure 38F:
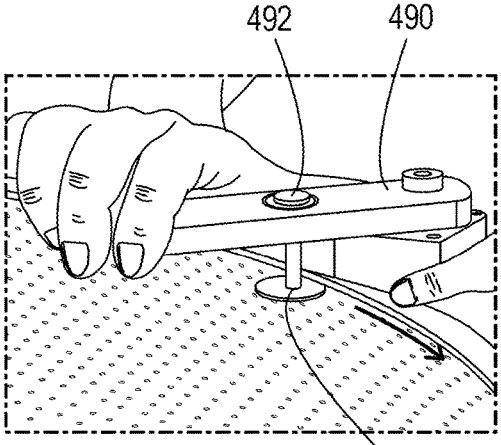
Figure 38G:
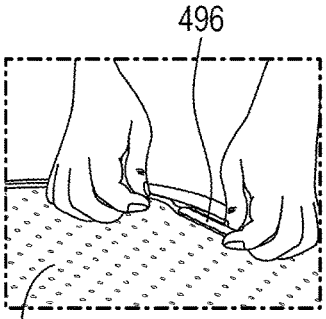
Figure 38H:
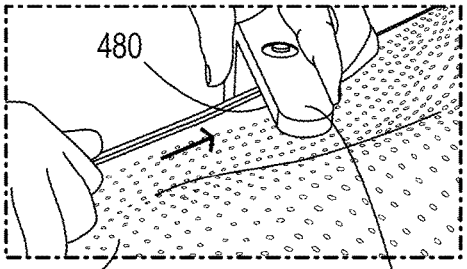
Figure 38I:
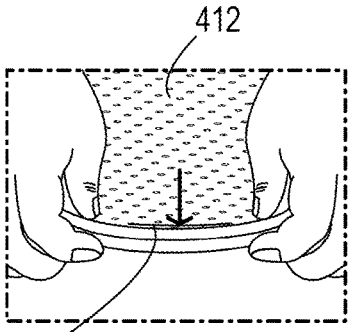

FIGS. 38A-38I illustrate a method of installing a keder strip 440 in a cover 412. This method can be used in place of the method described above with any of the keder strip embodiments. The keder strip 440 can be similar to any of the keder strips described above. The keder strip 440 is inserted into a channel of a receiver 464 on the cover 412 (FIG. 38A). The keder strip 440 is centered in the receiver 464, and an edge of the cover 412 is positioned along a cavity 476 of the keder strip 440 (FIG. 38B). The cover 412 is placed flat on a table (FIG. 38C) and is slid under a mounting aid 484 (FIG. 38D). The mounting aid 484 includes a lever 490, a pin 492 slidably mounted on the lever 490, and a wheel 491 rotatably mounted on the pin 492. The pin 492 is pushed upwards so the lever 490 can be rotated across the keder strip 440 and over the cover 412 (FIG. 38E). The wheel 491 is pushed into the cavity 476 of the keder strip 440, and the lever 490 is held in tension as the cover 412 is rotated so that the edge of the cover 412 is pushed into the cavity 476 (FIG. 38F). A center clip 496 is placed on ends of the keder strip 440 (FIG. 38G). As illustrated in FIGS. 38C-38F, steps C through F are repeated with a spline 480 being pushed into the cavity 476 (FIG. 38H). The clip 496 is inserted on the ends of the keder strip 440 (FIG. 38I).

Figure 39:
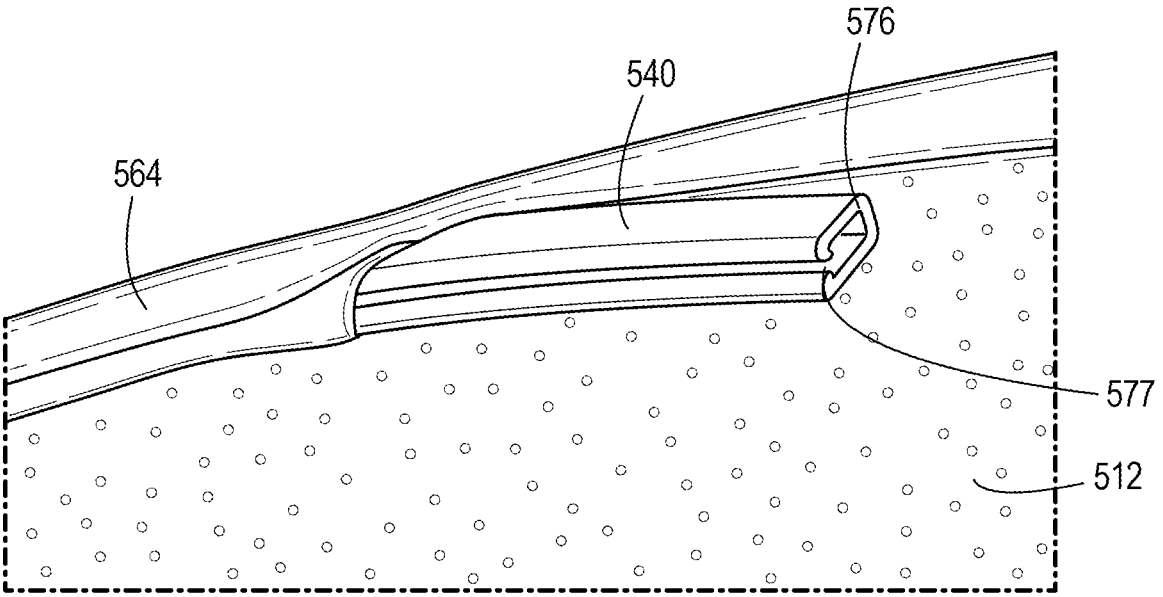
FIG. 39 is an enlarged perspective view of a portion of a cover assembly according to some embodiments.
Figure 40:
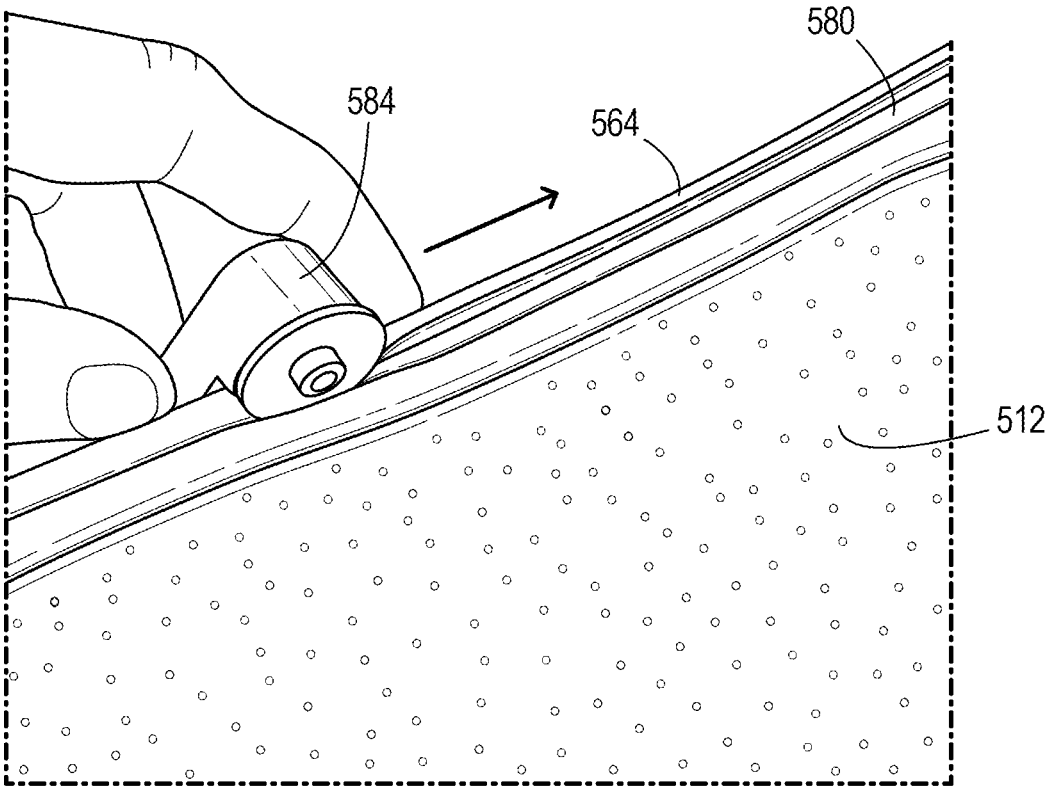
FIG. 40 is an enlarged perspective view of the portion of the cover assembly shown in FIG. 39 and a roller tool.

FIGS. 39 and 40 illustrate a method of installing a keder strip 540 in a chair cover 512 according to some embodiments. This method can be used in place of the methods described above and with any of the keder strip embodiments as described in this disclosure. The keder strip 540 can be similar to the keder strips described in this disclosure, and the following differences explained below. The chair cover 512 can be similar to the chair covers described in this disclosure, and the following differences explained below. A user can feed the keder strip 540 through an inlet of a receiver 564 of the chair cover 512. Once the entire keder strip 540 is in the receiver 564, a spline 580 is aligned with an opening 577 of the keder strip 540 on an outside of the receiver 564. A roller tool 584 pushes the spline 580 and a portion of the receiver 564 through the opening 577 and into a cavity 576 of the keder strip 540 to secure the keder strip 540, the receiver 564 and the spline 580.

Figure 41:
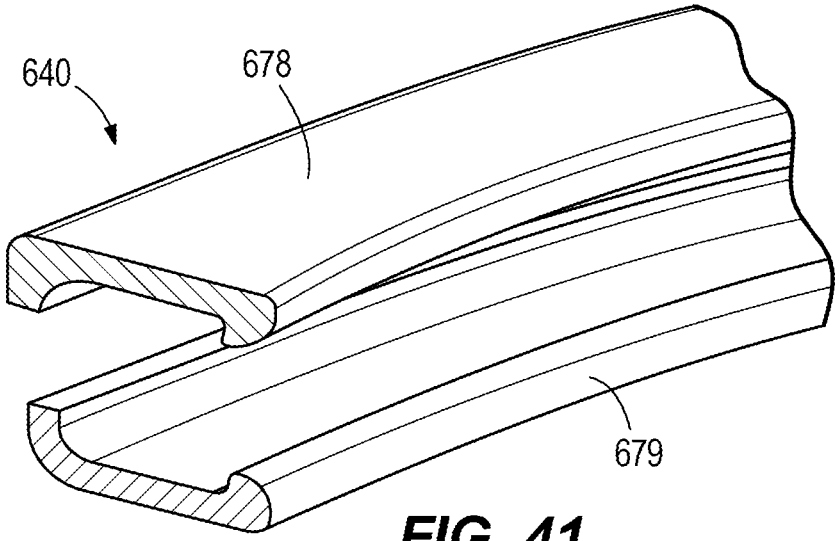
FIG. 41 is an exploded perspective view of a portion of a keder strip according to some embodiments.
Figure 42:
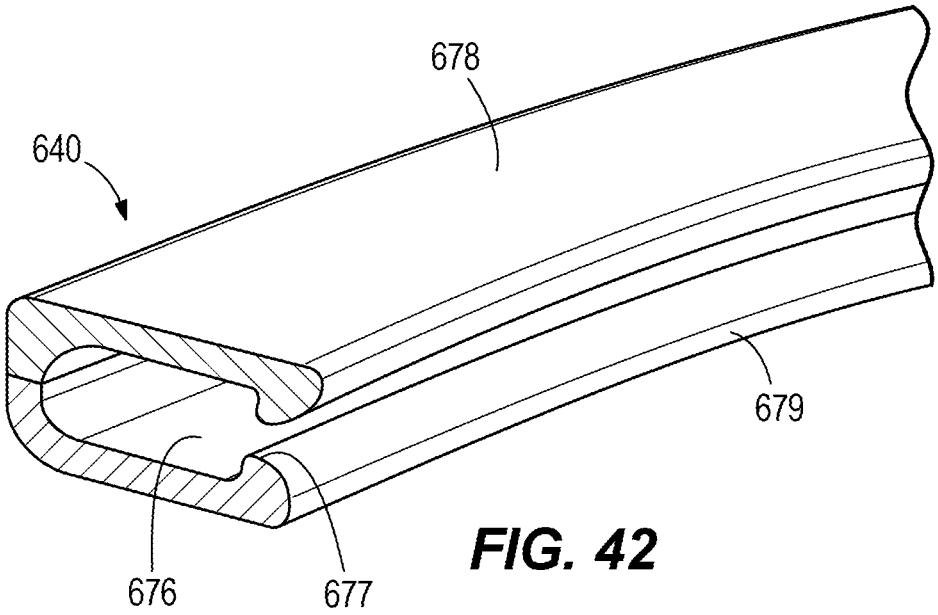
FIG. 42 is a perspective view of the portion of the keder strip of the cover assembly shown in FIG. 36.

FIGS. 41 and 42 illustrate a keder strip 640 according to some embodiments. The keder strip 640 can be similar to the keder strips as described in this disclosure, and the following differences explained below. The keder strip 640 can be used in place of any of the keder strips described above in any of the embodiments. The keder strip 640 can be an elastic or flexible strip. The keder strip 640 can further be a strip assembly. The keder strip 640 further includes a U-shaped cross section defining a cavity 676 and an opening 677 which opens into the cavity 676. The keder strip 640 may be formed from molded plastic or polymer material. The keder strip 640 includes a first portion 678 and a second portion 679 coupled to the first portion 678. The first portion 678 and the second portion 679 may be coupled via a snap-fit, heat staking, or welding (e.g., hot plate welding, vibration welding, etc.). In other embodiments, the first portion 678 and the second portion 679 may be formed as one-piece. The first portion 678 and the second portion 679 define the cavity 676 and the opening 677. The opening 677 has a smaller width than the cavity 676.

Figure 43:
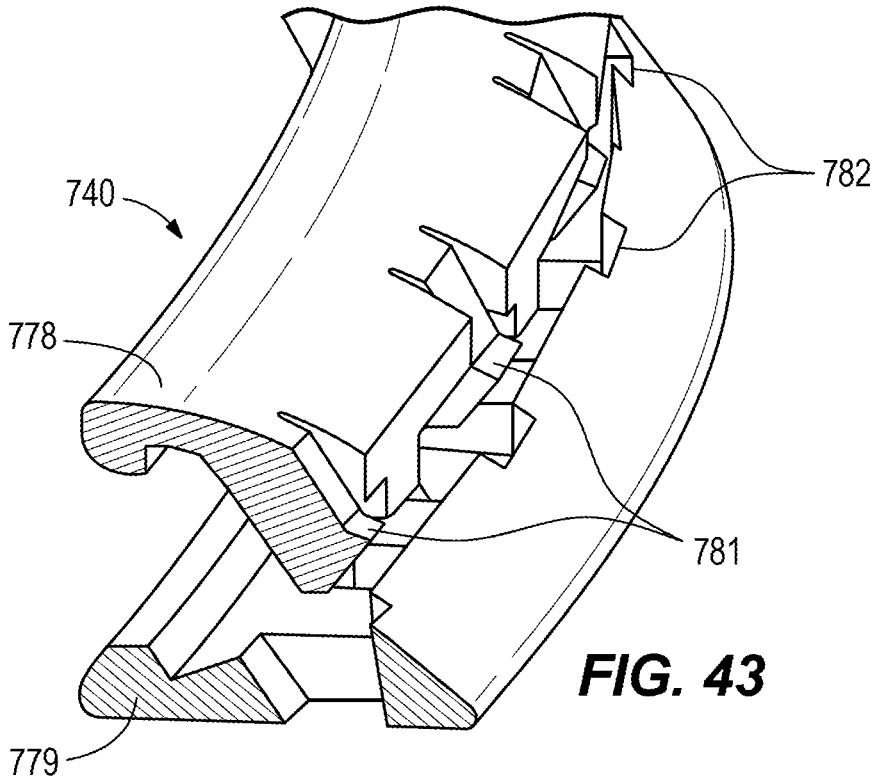
FIG. 43 is an exploded perspective view of a portion of a keder strip according to some embodiments.
Figure 44:
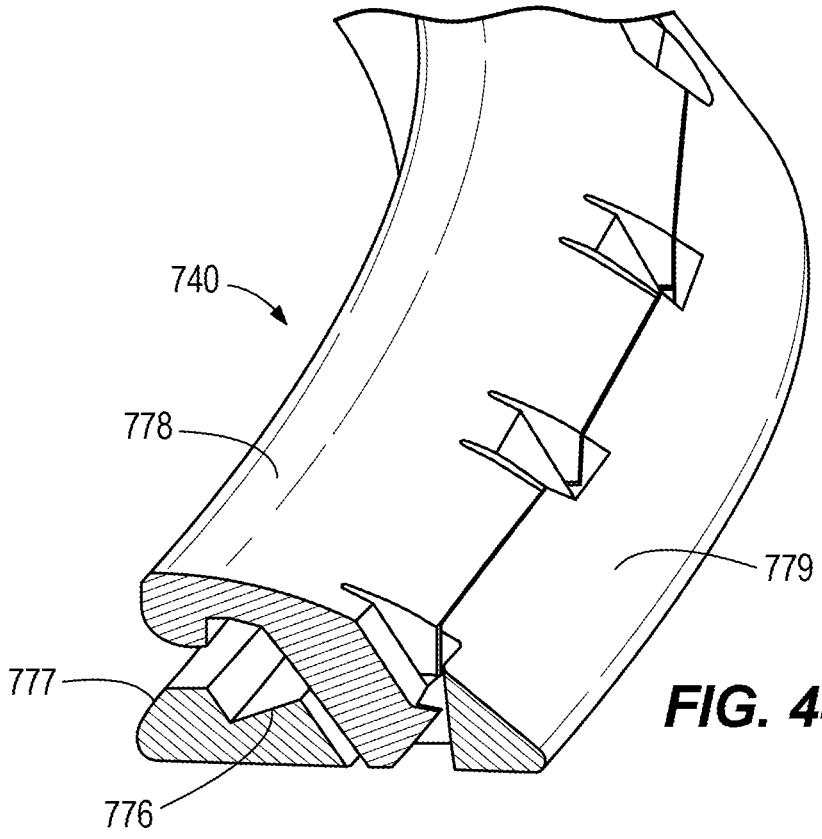
FIG. 44 is a perspective view of the portion of the keder strip shown in FIG. 40.

FIGS. 43 and 44 illustrate a keder strip 740 according to some embodiments. The keder strip 740 can be similar to the keder strips as described in this disclosure, and the following differences explained below. The keder strip 740 can be used in place of any of the keder strips described above in any of the embodiments. The keder strip 740 can be an elastic or flexible strip. The keder strip 740 can further be a strip assembly. The keder strip 740 further includes a Y-shaped cross section defining a cavity 776 and an opening 777 which opens into the cavity 776. The keder strip 740 may be formed from molded plastic or polymer material. The keder strip 740 includes a first portion 778 and a second portion 779 coupled to the first portion 778. The first portion 778 and the second portion 779 are coupled via a snap-fit. The first portion 778 includes a plurality of projections 781. The second portion 779 includes a plurality of recesses 782 receiving the projections 781 of the first portion 778. The projections 781 latch on to the second portion 779 within the recesses 782.

Figure 47:
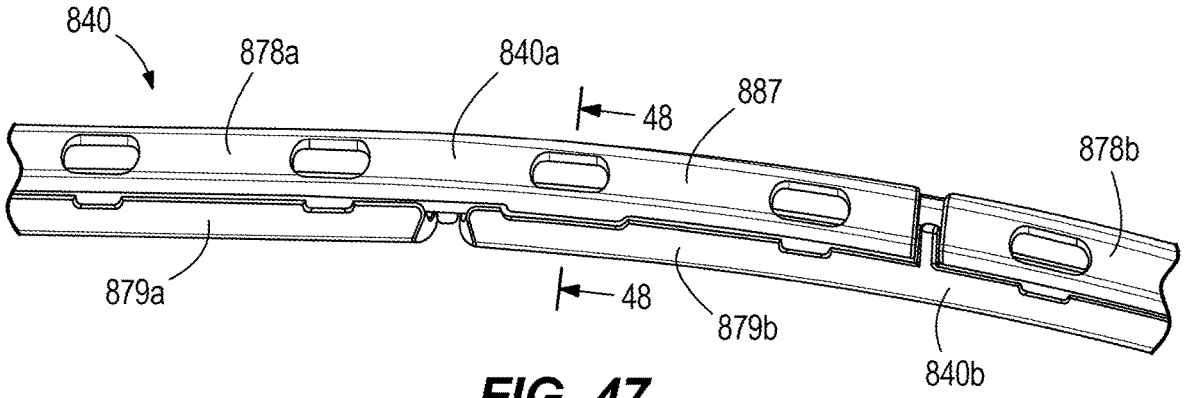
FIG. 47 is an enlarged perspective view of a portion of the keder strip shown in FIG. 45.
Figure 48:
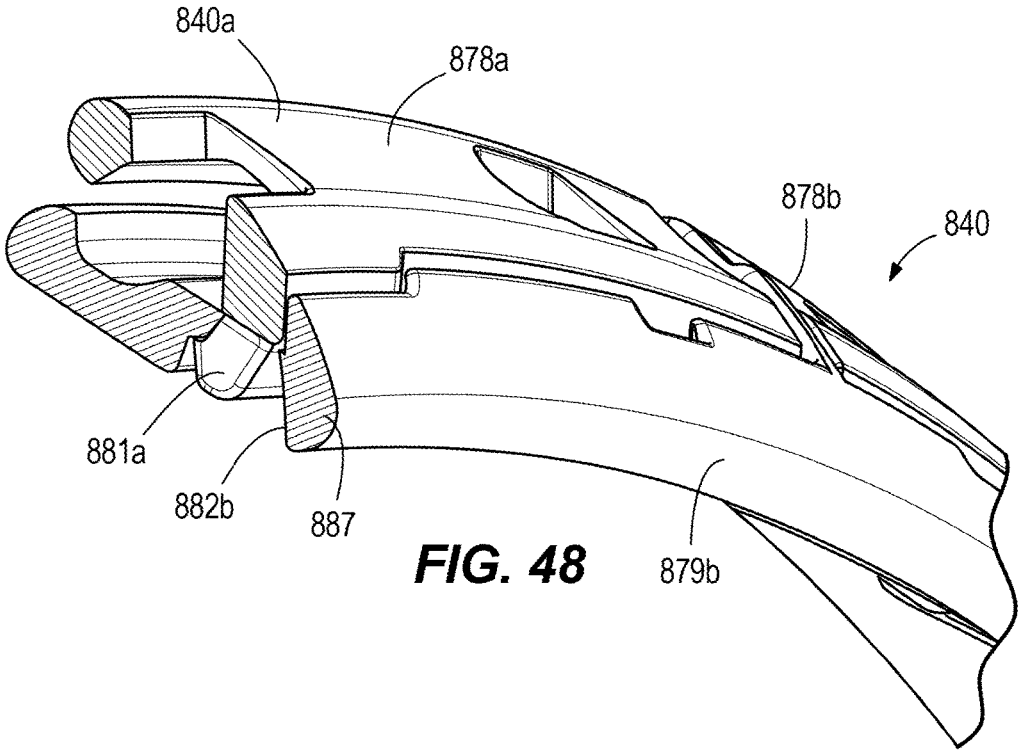
FIG. 48 is a cross-sectional view of the portion of the keder strip through section 48-48 in FIG. 47.
Figure 49:
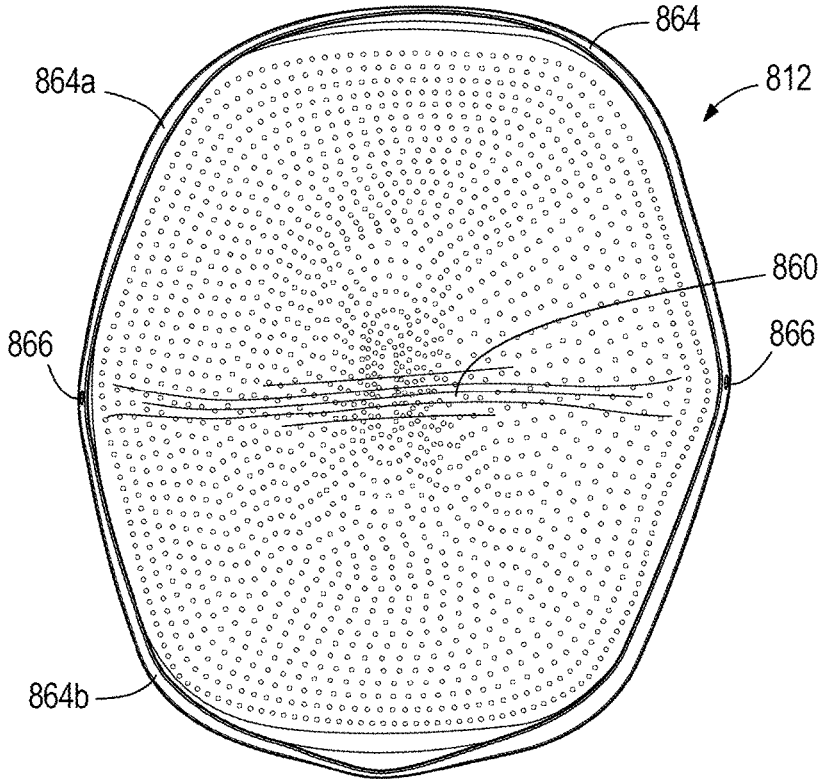
FIG. 49 is a perspective view of a chair cover configured for use with the keder strip shown in FIG. 45.

FIGS. 45-50 illustrate a keder strip 840 in a chair cover 812 according to some embodiments. The keder strip 840 can be similar to the keder strips as described in this disclosure, and the following differences explained below. The cover 812 can be similar to the chair covers as described in this disclosure, and the following differences explained below. The keder strip 840 can be used in place of any of the keder strips described above in any of the embodiments. The chair cover 812 can be used in place of any of the chair covers described above in any of the embodiments. The chair cover 812 includes a first receiver 860 and a second receiver 864 knitted as one-piece with the chair cover 812 (FIG. 49). The second receiver 864 is arranged on a perimeter of the cover 812. The second receiver 864 has two opposing cuts 866 on each side of the cover 812. The two opposing cuts 866 separate a first half 864*a*, or first portion, of the second receiver 864 from a second half 864*b*, or second portion, of the second receiver 864.

Figure 45:
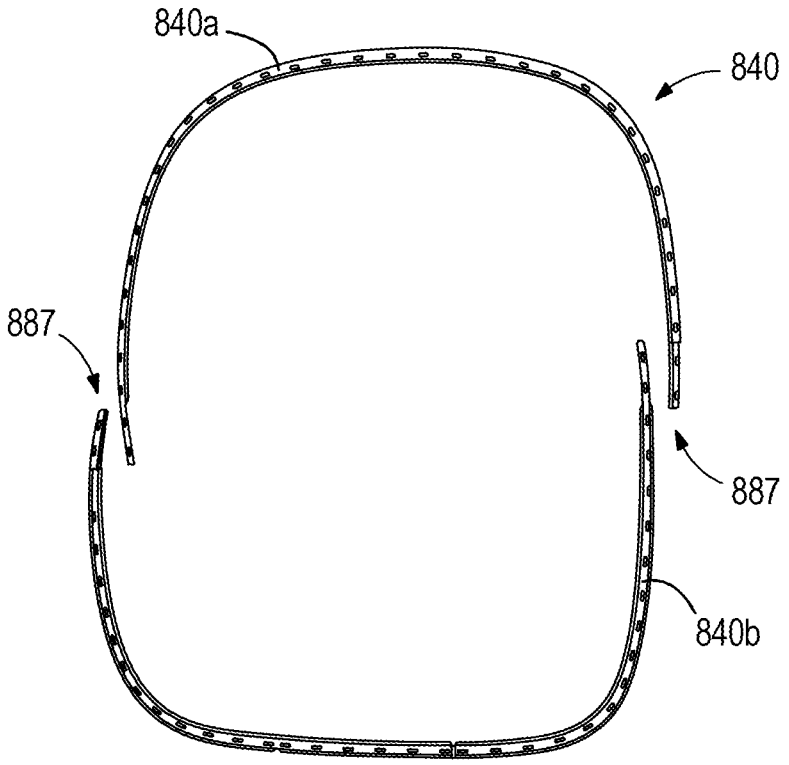
FIG. 45 is an exploded front view of a keder strip according to some embodiments.
Figure 46:
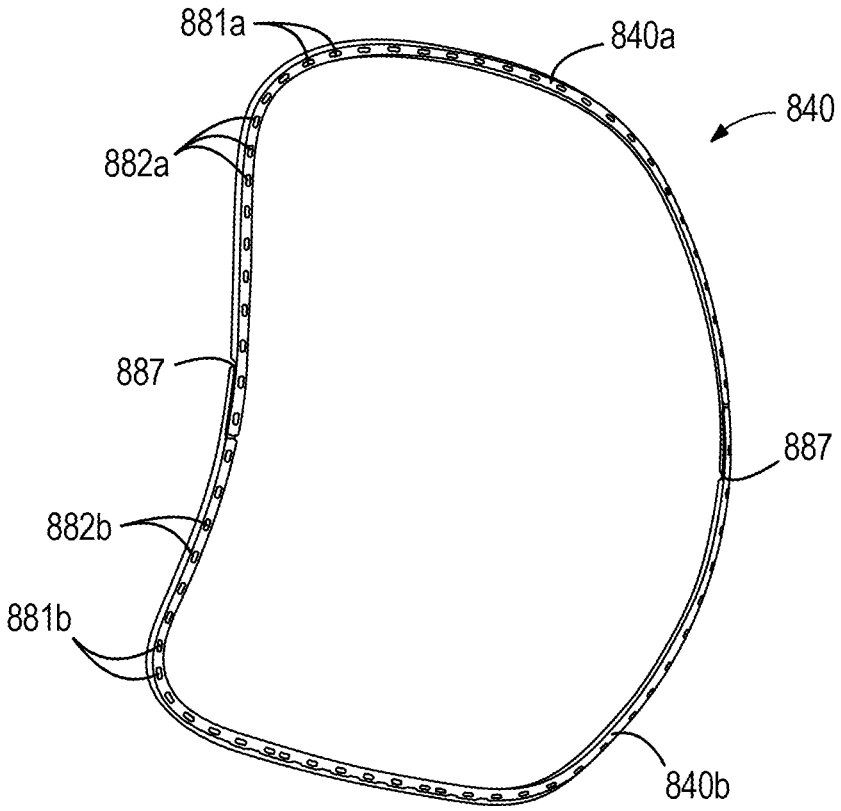
FIG. 46 is a perspective view of the keder strip shown in FIG. 45.

With reference to FIGS. 45 and 46, the keder strip 840 can be an elastic or flexible strip. The keder strip 840 can further be a strip assembly. The keder strip 840 further includes a first half or first segment 840*a*, and a second half or second segment 840*b*. The first half 840*a* includes a first portion 878*a* having a plurality of projections 881*a* and a second portion 879*a* having a plurality of recesses 882*a*. The second half 840*b* has a first portion 878*b* having a plurality of snap hooks 881*b* and a second portion 879*b* having a plurality of recesses 882*b* (FIGS. 46 and 47). The first half 840*a* and the second half 840*b* are coupled via a pair of opposing lap joints 887 (FIGS. 47 and 48). The lap joints 887 create a closed loop of the keder 840. The projections 881*a* of the first half 840*a* and the recesses 882*b* of the second half 840*b* are coupled to each other in one of the lap joints 887. The projections 881*b* of the second half 840*b* and the recesses 882*a* of the first half 840*a* are coupled to each other the other one of the lap joints 887.

Figure 50:
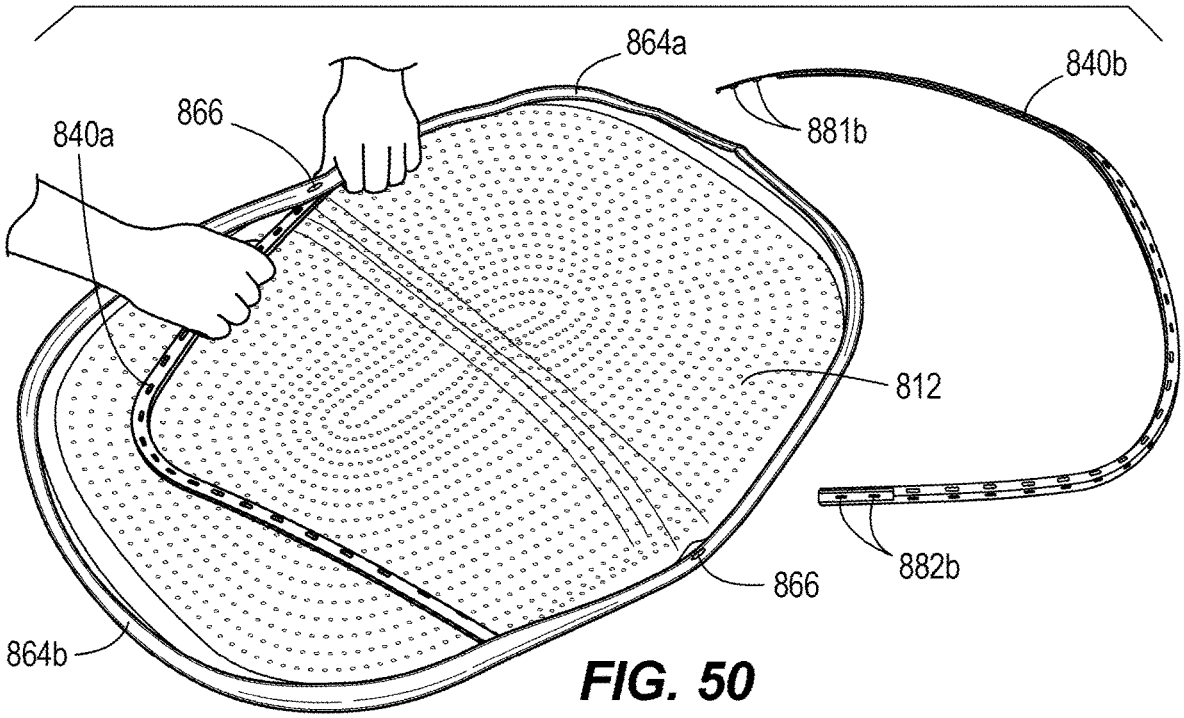
FIG. 50 is a perspective view of the chair cover and the keder strip shown in FIG. 45.

With reference to FIGS. 49 and 50, the first half 840*a* of the keder strip 840 is inserted into the first half 864*a* of the second receiver 864 through one of the cuts 866, and the second half 840*b* of the keder strip 840 is inserted into the second half 864*b* of the second receiver 864 through one of the cuts 866. After the halves 840*a*, 840*b* of the keder strip 840 are positioned in the second receiver 864, the halves 840*a*, 840*b* are coupled via the lap joints 887.

Although certain features were described above with reference to particular embodiments, each of the features may be used in combination with each other in various embodiments. For example, different attachment mechanisms (including keder strips and splines) may be used with different styles of covers. In addition, any or all of the covers may or may not include cushions or padding.

Various features and advantages of the invention are set forth in the following claims.

What is claimed is:

1. A cover assembly for a chair, the chair including a first surface configured to support a user and a second surface opposite the first surface, the cover assembly comprising:

a chair cover configured to be positioned over at least a portion of the first surface of the chair; and an attachment mechanism configured to couple the chair cover to the chair, the attachment mechanism including a flexible strip coupled to a perimeter of the chair cover and configured to be arranged on the second surface of the chair, wherein the flexible strip includes a first portion and a second portion, and wherein the first portion and the second portion define a cavity therebetween, and a tensioning element coupled to the chair cover and including an attachment feature, the attachment feature configured to be coupled to the chair to create a tensioning force in the chair cover.

2. The cover assembly of claim 1, wherein the chair cover is formed from a knit material.

3. The cover assembly of claim 1, wherein the chair cover includes a first receiver that receives the tensioning element and a second receiver that receives the flexible strip.

4. The cover assembly of claim 3, wherein the first receiver is a first tube formed in the chair cover, and wherein the second receiver is a second tube formed in the chair cover.

5. The cover assembly of claim 1, wherein the first portion includes a plurality of projections, wherein the second portion includes a plurality of recesses, and wherein the plurality of recesses receives the plurality of projections via a snap-fit connection.

6. The cover assembly of claim 1, wherein the attachment mechanism further includes a spline disposed within the cavity, and wherein a portion of the chair cover is captured between an interior surface of the flexible strip and the spline.

7. The cover assembly of claim 1, wherein the tensioning element includes a C-shaped clip.

8. The cover assembly of claim 1, wherein the attachment feature includes a projection.

9. The cover assembly of claim 1, wherein the attachment feature is a first attachment feature located on a first end of the tensioning element, wherein the tensioning element includes a second attachment feature located on a second end of the tensioning element opposite the first end, and wherein the second attachment feature is also configured to be coupled to the chair to create the tensioning force in the chair cover.

10. The cover assembly of claim 1, wherein the tensioning element is coupled to an edge of the chair cover.

11. The cover assembly of claim 1, wherein the tensioning element is coupled to a mid-portion of the chair cover.

12. The cover assembly of claim 1, wherein the flexible strip extends around part of the perimeter of the chair cover.

13. The cover assembly of claim 12, wherein the flexible strip is a first flexible strip, wherein the attachment mechanism includes a second flexible strip coupled to the perimeter of the chair cover and configured to be arranged on the second surface of the chair, and wherein the second flexible strip is spaced apart from the first flexible strip and extends around another part of the perimeter of the chair cover.

14. The cover assembly of claim 1, wherein the flexible strip extends around an entire perimeter of the chair cover.

15. A cover assembly for a chair, the cover assembly comprising:

a chair cover; and an attachment mechanism configured to couple the chair cover to the chair, the attachment mechanism including a flexible strip assembly coupled to a perimeter of the chair cover, the flexible strip assembly including a first part and a second part coupled together via a lap joint, and a tensioning element coupled to the chair cover and including an attachment feature, the attachment feature configured to be coupled to the chair to create a tensioning force in the chair cover.

16. The cover assembly of claim 15, wherein the first part and the second part of the flexible strip assembly form a closed loop.

17. The cover assembly of claim 16, wherein the lap joint is a first lap joint, and wherein the first part and the second part are also coupled together via a second lap joint.

18. The cover assembly of claim 15, wherein the first part of the flexible strip assembly includes projections, wherein the second part of the flexible strip assembly includes recesses, and wherein the projections are coupled to each other in the lap joint.

19. The cover assembly of claim 15, wherein the flexible strip assembly defines a cavity, wherein the attachment mechanism includes a spline disposed within the cavity, and wherein a portion of the chair cover is captured between an interior surface of the flexible strip assembly and the spline.

20. A chair assembly comprising:

a base;

a seat supported by the base, the seat having a seat surface configured to support a user and a bottom surface opposite the first surface; and a cover assembly coupled to the seat, the cover assembly including a chair cover positioned over at least a portion of the seat surface of the seat, and an attachment mechanism coupling the chair cover to the chair assembly, the attachment mechanism including a flexible strip coupled to a perimeter of the chair cover and arranged on the bottom surface of the seat, the flexible strip defining a cavity, a tensioning element coupled to the chair cover and including an attachment feature, the attachment feature coupled to another component of the chair assembly to create a tensioning force in the chair cover, and a spline disposed within the cavity of the flexible strip, wherein a portion of the chair cover is captured between an interior surface of the flexible strip and the spline.

21. The chair assembly of claim 20, further comprising a backrest having a front surface and a rear surface, wherein the chair cover is also positioned over at least a portion of the front surface of the backrest, and wherein the flexible strip is also arranged on the rear surface of the backrest.

22. A cover assembly for a chair, the chair including a first surface configured to support a user and a second surface opposite the first surface, the cover assembly comprising:

a chair cover configured to be positioned over at least a portion of the first surface of the chair; and an attachment mechanism configured to couple the chair cover to the chair, the attachment mechanism including a flexible strip coupled to a perimeter of the chair cover and configured to be arranged on the second surface of the chair, and a tensioning element coupled to the chair cover and including an attachment feature, the attachment feature configured to be coupled to the chair to create a tensioning force in the chair cover, wherein the attachment feature includes a projection.

* * * * *